US008375854B2

(12) United States Patent
Saito

(10) Patent No.: US 8,375,854 B2
(45) **Date of Patent: *Feb. 19, 2013**

(54) SHEET PROCESSING APPARATUS

(75) Inventor: Hirofumi Saito, Ibaraki (JP)

(73) Assignee: Komori Corporation, Tokyo (JP)

( * ) Notice: Subject to any disclaimer, the term of this patent is extended or adjusted under 35 U.S.C. 154(b) by 958 days.

This patent is subject to a terminal disclaimer.

(21) Appl. No.: 12/070,648

(22) Filed: Feb. 20, 2008

(65) Prior Publication Data

US 2009/0008854 A1 Jan. 8, 2009

(30) Foreign Application Priority Data

Feb. 21, 2007 (JP) ..... 2007-040449

(51) Int. Cl.
*B41F 7/02* (2006.01)

(52) U.S. Cl. ..... 101/218; 101/184; 101/185; 101/247

(58) Field of Classification Search ..... 101/218, 101/247, 183, 184, 185; 118/46, 212, 227, 118/244, 255, 262
See application file for complete search history.

(56) References Cited

U.S. PATENT DOCUMENTS

| | | | | |
|---|---|---|---|---|
| 4,372,201 | A * | 2/1983 | Dudziak et al. | 100/7 |
| 4,458,591 | A * | 7/1984 | Guaraldi | 101/247 |
| 4,676,158 | A * | 6/1987 | Ishii et al. | 101/218 |
| 5,320,038 | A | 6/1994 | Fischer | |
| 5,588,362 | A * | 12/1996 | Sugiyama et al. | 101/218 |
| 6,213,016 | B1 * | 4/2001 | Tsunashima | 101/218 |
| 6,772,709 | B2 * | 8/2004 | Shibata | 118/46 |
| 2002/0096070 | A1 * | 7/2002 | Friedrichs et al. | 101/247 |
| 2006/0201352 | A1 | 9/2006 | Saito | |
| 2006/0266238 | A1 | 11/2006 | Derhardt | |
| 2007/0221075 | A1 * | 9/2007 | Kundgen et al. | 101/218 |

FOREIGN PATENT DOCUMENTS

| | | | |
|---|---|---|---|
| DE | 10 2004 016 673 | A1 | 10/2005 |
| EP | 1 319 508 | A1 | 6/2003 |
| JP | 02-098444 | | 4/1990 |
| JP | 07-299897 | | 11/1995 |
| JP | 2585995 | Y | 9/1998 |
| JP | 2003-182031 | A | 7/2003 |
| JP | 2004 050849 | A | 2/2004 |
| JP | 2006-250202 | A | 9/2006 |

* cited by examiner

*Primary Examiner* — Ren Yan
(74) *Attorney, Agent, or Firm* — Blakely, Sokoloff, Taylor & Zafman

(57) ABSTRACT

A sheet processing apparatus includes a first cylinder, second cylinder, third cylinder, first driving device, second driving device, third driving device, thickness input device, and controller. The first cylinder receives a sheet from an upstream transport cylinder and holds the sheet. The second cylinder is disposed to oppose the first cylinder and prints/coats the sheet held by the first cylinder. The third cylinder is disposed to oppose the first cylinder and supplies ink/varnish to a circumferential surface of the first cylinder. The first driving device adjusts a gap amount between the first cylinder and the upstream transport cylinder. The second driving device adjusts the position of the second cylinder with respect to the first cylinder. The third driving device adjusts the position of the third cylinder with respect to the first cylinder. The thickness input device inputs the thickness of the sheet. The controller controls the first driving device, the second driving device, and the third driving device in accordance with the sheet thickness from the thickness input device.

2 Claims, 20 Drawing Sheets

SHEET PROCESSING APPARATUS

BACKGROUND OF THE INVENTION

The present invention relates to a sheet processing apparatus which prints or coats the two surfaces, obverse, and reverse of a sheet.

Conventionally, as shown in Japanese Patent Laid-Open No. 2003-182031, a sheet processing apparatus has been proposed which comprises a blanket impression cylinder which opposes the last impression cylinder of a printing unit and receives a sheet from the last impression cylinder, a lower blanket cylinder which opposes the blanket impression cylinder in the upstream sheet convey direction of a position where the blanket cylinder opposes the last impression cylinder, and an upper blanket cylinder which opposes the blanket impression cylinder in the downstream sheet convey direction of the opposing point where the blanket impression cylinder opposes the last impression cylinder and supplies varnish to the surface of the sheet. As shown in Japanese Utility Model Registration No. 2,585,995, a sheet processing apparatus has been proposed in which an eccentric bearing supports a blanket cylinder opposing an impression cylinder and a cylinder throw on/off mechanism pivots the eccentric bearing to throw on/off the blanket cylinder.

In the conventional sheet processing apparatuses described above, when transferring a sheet from the last impression cylinder to the blanket impression cylinder, if the sheet is scratched depending on the thickness or material of the sheet to be processed, the packing combination of the blanket impression cylinder is changed to change the gap amount between the circumferential surfaces of the last impression cylinder and blanket impression cylinder. Accordingly, each time the sheet type changes, the packing combination of the blanket impression cylinder must be changed, which requires time. This increases the load to the operator to degrade the productivity.

When the packing combination of the blanket impression cylinder changes, the printing pressure between the blanket impression cylinder and upper blanket cylinder and that between the blanket impression cylinder and lower blanket cylinder change to degrade the printing quality. To prevent this, the eccentric bearings of the upper and lower blanket cylinders are pivoted, thus adjusting the printing pressures of the upper and lower blanket cylinders. As this adjustment must be performed repeatedly while checking the quality, a large amount of paper is wasted. Also, this adjustment must be performed each time the packing combination of the blanket impression cylinder changes, requiring time.

SUMMARY OF THE INVENTION

It is an object of the present invention to provide a sheet processing apparatus in which an adjustment time to maintain the processing quality of a sheet is shortened to improve the productivity.

In order to achieve the above object, according to the present invention, there is provided a sheet processing apparatus comprising a first cylinder which receives a sheet from an upstream transport cylinder and holds the sheet, a second cylinder which is disposed to oppose the first cylinder and prints/coats the sheet held by the first cylinder, a third cylinder which is disposed to oppose the first cylinder and supplies ink/varnish to a circumferential surface of the first cylinder, first driving means for adjusting a gap amount between the first cylinder and the upstream transport cylinder, second driving means for adjusting a position of the second cylinder with respect to the first cylinder, third driving means for adjusting a position of the third cylinder with respect to the first cylinder, thickness input means for inputting a thickness of the sheet, and control means for controlling the first driving means, the second driving means, and the third driving means in accordance with the sheet thickness from the thickness input means.

DESCRIPTION OF THE PREFERRED EMBODIMENTS

A sheet processing apparatus according to the first embodiment of the present invention will be described with reference to FIGS. 1 to 10.

Figure 1:
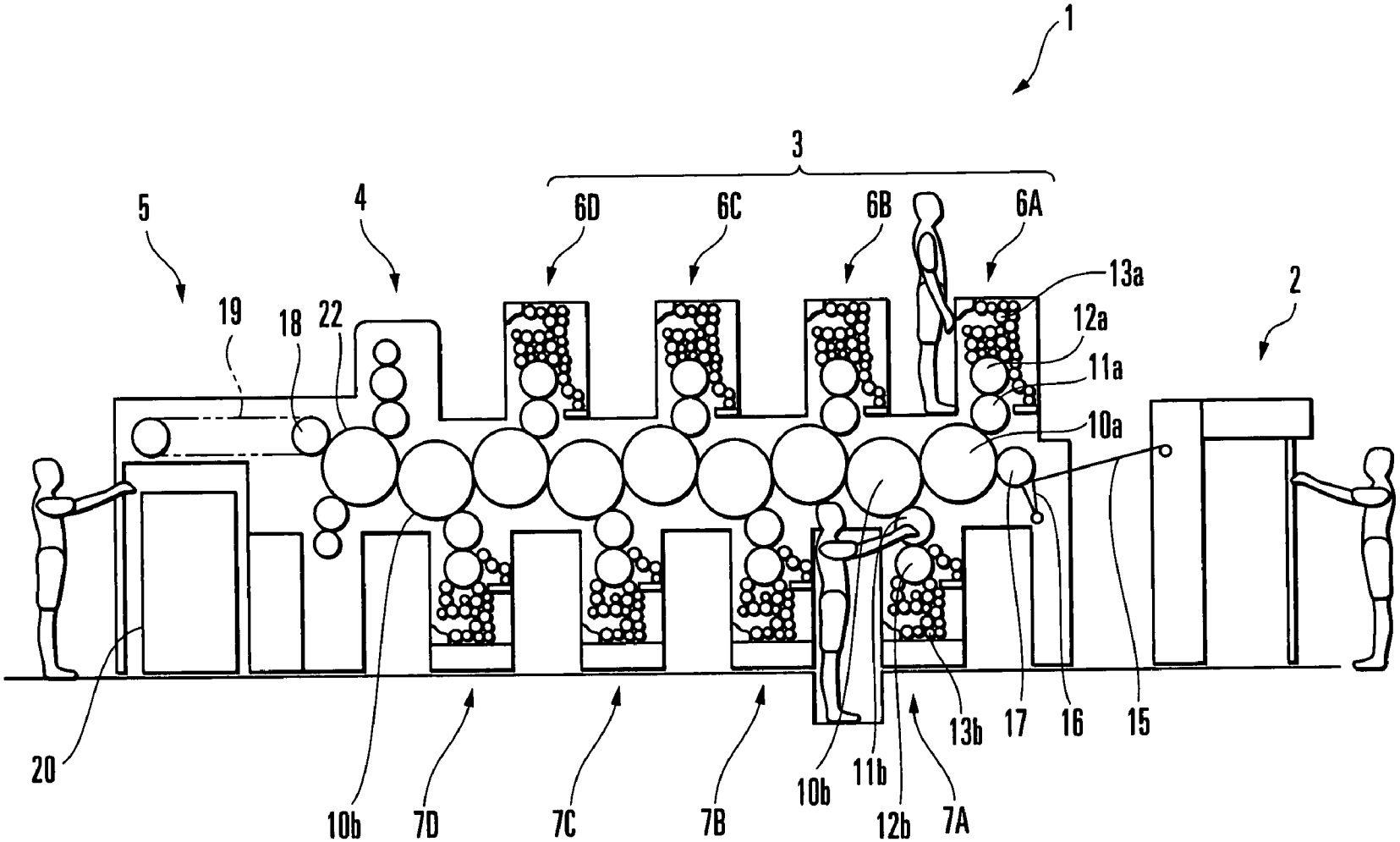
FIG. 1 is a side view of a sheet-fed rotary printing press to which a sheet processing apparatus according to the present invention is applied.

As shown in FIG. 1, a sheet-fed rotary printing press 1 to which a sheet processing apparatus according to the first embodiment is applied comprises a feeder 2 for feeding a sheet, a printing unit 3 serving as a liquid transfer device which prints the sheet fed from the feeder 2, a coating unit 4 serving as a liquid transfer device which coats with varnish one or both of the obverse and reverse of the sheet printed by the printing unit 3, and a delivery unit 5 serving as a delivery unit to which the sheet coated by the coating unit 4 is delivered. The printing unit 3 comprises first to fourth obverse printing units 6A to 6D serving as an obverse processing unit, and first to fourth reverse printing units 7A to 7D serving as a reverse processing unit.

Each of the obverse printing units 6A to 6D comprises a double-diameter impression cylinder 10*a* (convey means) serving as a transport cylinder which has grippers (sheet holding means) for gripping a sheet in its peripheral portion, a blanket cylinder 11*a* serving as a transfer cylinder which opposes the upper portion of the impression cylinder 10*a*, a plate cylinder 12*a* which opposes the upper portion of the blanket cylinder 11*a*, and an inking unit 13*a* serving as a liquid supply unit which supplies ink as a liquid to the plate cylinder 12*a*.

Each of the reverse printing units 7A to 7D comprises a double-diameter impression cylinder 10*b* (convey means) serving as a transport cylinder which has grippers (sheet holding means) for gripping a sheet in its peripheral portion, a blanket cylinder 11*b* serving as a transfer cylinder which opposes the lower portion of the impression cylinder 10*b*, a plate cylinder 12*b* which opposes the lower portion of the blanket cylinder 11*b*, and an inking unit 13*b* serving as a liquid supply unit which supplies ink as a liquid to the plate cylinder 12*b*.

In this arrangement, the leading edge of a sheet supplied from the feeder 2 onto a feeder board 15 is gripped by a swing arm shaft pregripper 16 and gripping-changed to the grippers of the impression cylinder 10*a* of the first obverse printing unit 6A. The sheet gripped by the grippers of the impression cylinder 10*a* is printed in the first color as it passes between the impression cylinder 10*a* and blanket cylinder 11*a*. The sheet the obverse of which is printed in the first color is gripping-changed to the impression cylinder 10*b* of the first reverse printing unit 7A, and is printed in the first color on its reverse as it passes between the impression cylinder 10*b* and blanket cylinder 11*b*.

Subsequently, second to fourth obverse printing units 6B to 6D and second to fourth reverse printing units 7B to 7D print in the second to fourth colors. The coating unit 4 coats the sheet, which is printed in four colors on each of its obverse and reverse, with varnish as a liquid. The coated sheet is gripping-changed to the delivery grippers (sheet holding means; not shown) of a delivery chain 19 (convey means) of the delivery unit 5, is conveyed by the delivery chain 19, and falls on a delivery pile 20 and piles there.

Figure 2:
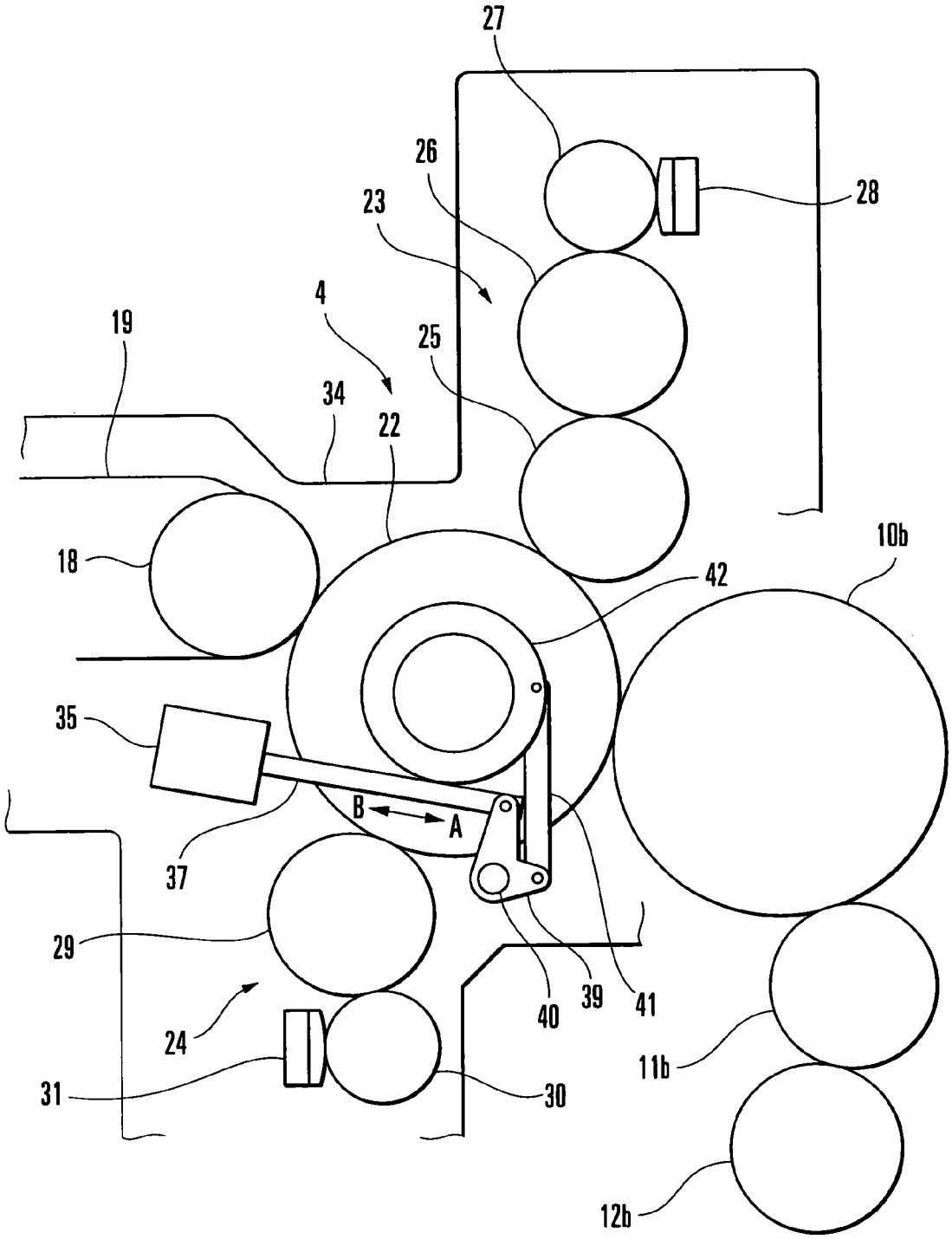
FIG. 2 is a side view of the main part showing cylinder arrangement in the sheet-fed rotary printing press shown in FIG. 1.

As shown in FIG. 2, the coating unit 4 comprises a coater double-diameter blanket cylinder 22 (first cylinder) serving as a reverse processing cylinder which opposes the impression cylinder 10*b* serving as the transport cylinder of the fourth reverse printing unit 7D. The coating unit 4 further comprises a first varnish coating device 23 (obverse processing means) which coats the obverse of the printed sheet, and a second varnish coating device 24 (reverse processing means) which coats the reverse of the printed sheet.

The first varnish coating device 23 comprises an upper blanket cylinder 25 (second cylinder) serving as an obverse processing cylinder which is disposed in the downstream sheet convey direction of a transfer point where the sheet held by the impression cylinder 10*b* is transferred to the coater double-diameter blanket cylinder 22, i.e., the opposing point of the coater double-diameter blanket cylinder 22 and impression cylinder 10*b*, and opposes the coater double-diameter blanket cylinder 22, a varnish film formation cylinder 26 which opposes the upper blanket cylinder 25, an anilox roller 27 which opposes the varnish film formation cylinder 26, and a chamber coater 28 which supplies varnish to the anilox roller 27. The anilox roller 27 and chamber coater 28 constitute an obverse liquid supply means.

The varnish supplied from the chamber coater 28 to the anilox roller 27 is transferred to the upper blanket cylinder 25 through the varnish film formation cylinder 26 and coats the printed obverse of the sheet passing between the upper blanket cylinder 25 and coater double-diameter blanket cylinder 22. When the sheet passes between the upper blanket cylinder 25 and coater double-diameter blanket cylinder 22, the varnish transferred from a lower blanket cylinder 29 (third cylinder) serving as the reverse blanket cylinder of the second varnish coating device 24 to the circumferential surface of the coater double-diameter blanket cylinder 22 coats the printed reverse of the sheet with the printing pressure of the upper blanket cylinder 25.

The second varnish coating device 24 comprises the lower blanket cylinder 29 which is disposed in the upstream rotational direction of the coater double-diameter blanket cylinder 22 of the opposing point of the coater double-diameter blanket cylinder 22 and impression cylinder 10*b* and opposes the coater double-diameter blanket cylinder 22, an anilox roller 30 which opposes the lower blanket cylinder 29, and a chamber coater 31 which supplies the varnish to the anilox roller 30. The varnish supplied from the chamber coater 31 to the anilox roller 30 is transferred to the circumferential surface of the coater double-diameter blanket cylinder 22 through the lower blanket cylinder 29. The anilox roller 30 and chamber coater 31 constitute a reverse liquid supply means.

Figure 4:
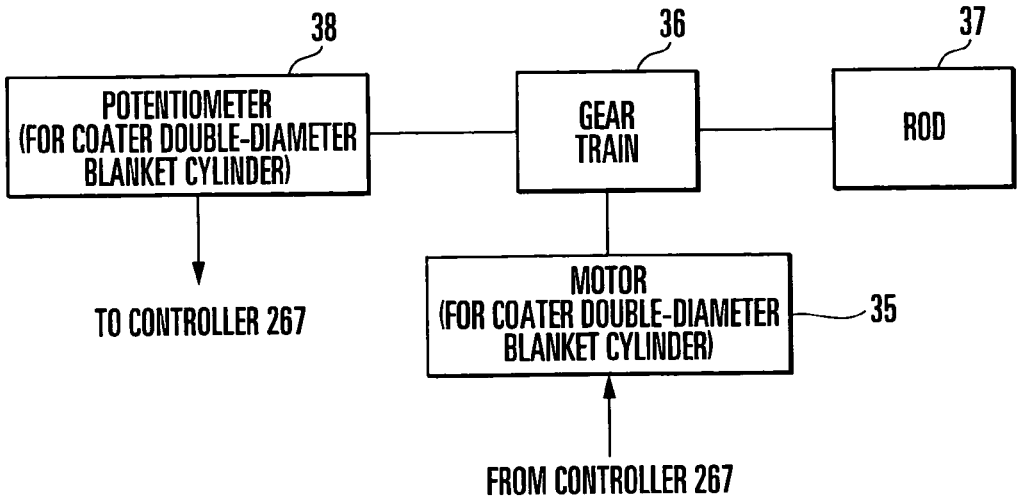
FIG. 4 is a view showing the connection state of the driving system of a motor for a coater double-diameter blanket cylinder shown in FIG. 1.

As shown in FIG. 4, a motor 35 (first driving means) for the coater double-diameter blanket cylinder which is attached to the frames 34 is connected to one end of a rod 37 through a gear train 36. When the motor 35 is driven in one direction, the rod 37 moves in the direction of an arrow A in FIG. 2 through the gear train 36. When the motor 35 is driven in the opposite direction, the rod 37 moves in the direction of an arrow B in FIG. 2 through the gear train 36. A potentiometer 38 (detection means) for the coater double-diameter blanket cylinder detects the current position of the coater double-diameter blanket cylinder 22. A controller 267 (to be described later) detects (calculates) a phase angle $\alpha$ of the motor 35 on the basis of an output from the potentiometer 38.

As shown in FIG. 2, an almost L-shaped lever 39 is fixed to one end of a shaft 40 which is rotatably supported between the pair of frames 34. One end of the lever 39 is pivotally mounted on the other end of the rod 37, and its other end is pivotally mounted on one end of a rod 41. A lever (not shown) is fixed to the other end of the shaft 40. An end of the lever is pivotally mounted on one end of a rod (not shown). The other end of this rod is pivotally mounted on an eccentric bearing (to be described later) which rotatably supports the other end shaft of the coater double-diameter blanket cylinder 22.

A pair of eccentric bearings 42 which rotatably support the two end shafts of the coater double-diameter blanket cylinder 22 are fitted on the pair of frames 34. The other end of the rod 41 is pivotally mounted on the corresponding eccentric bearing 42. In this arrangement, when the rod 37 moves in the direction of the arrow A and the lever 39 accordingly pivots clockwise about the shaft 40 as the center, the coater double-diameter blanket cylinder 22 separates from the impression cylinder 10*b* through the rod 41 and the corresponding eccentric bearing 42. This increases the gap amount between the circumferential surfaces of the coater double-diameter blanket cylinder 22 and impression cylinder 10*b*.

When the rod 37 moves in the direction of the arrow B and the lever 39 accordingly pivots counterclockwise about the shaft 40 as the center, the coater double-diameter blanket cylinder 22 moves close to the impression cylinder 10*b* through the rod 41 and the corresponding eccentric bearing 42. This decreases the gap amount between the circumferential surfaces of the coater double-diameter blanket cylinder 22 and impression cylinder 10*b*.

Figure 3:
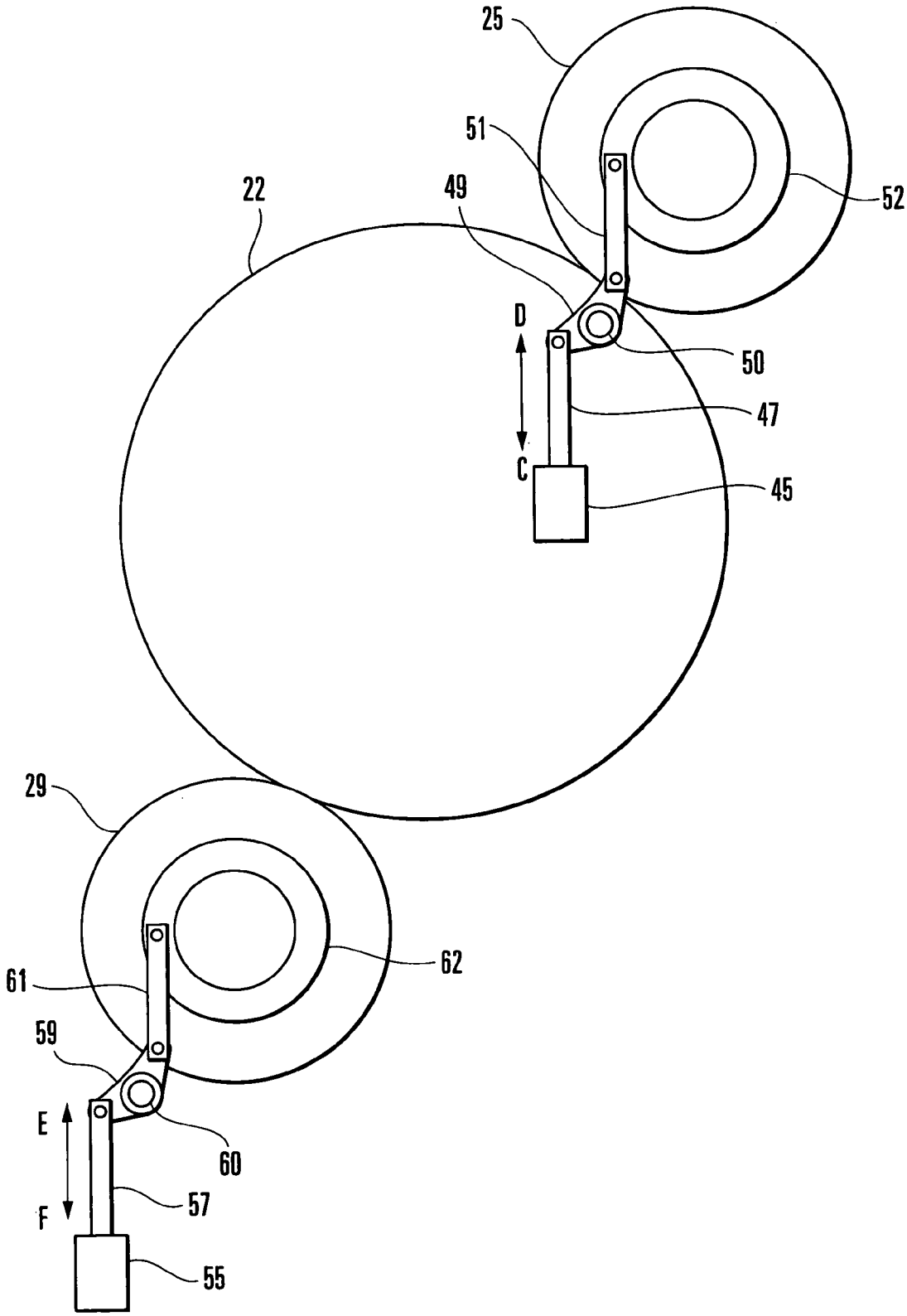
FIG. 3 is a side view of the main part to describe the second and third driving devices which adjust the positions of an upper blanket cylinder and lower blanket cylinder shown in FIG. 1.
Figure 5:
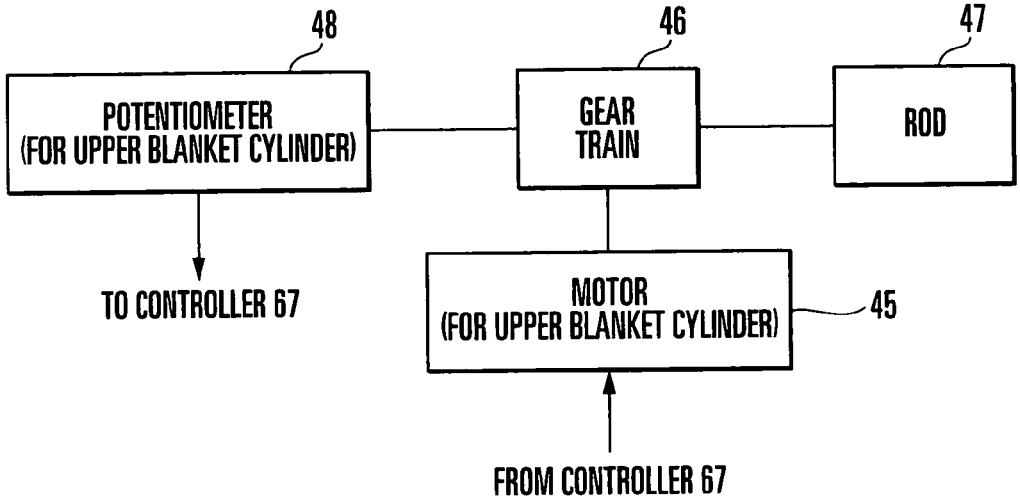
FIG. 5 is a view showing the connection state of the driving system of a motor for the upper blanket cylinder shown in FIG. 1.
Figure 7A:
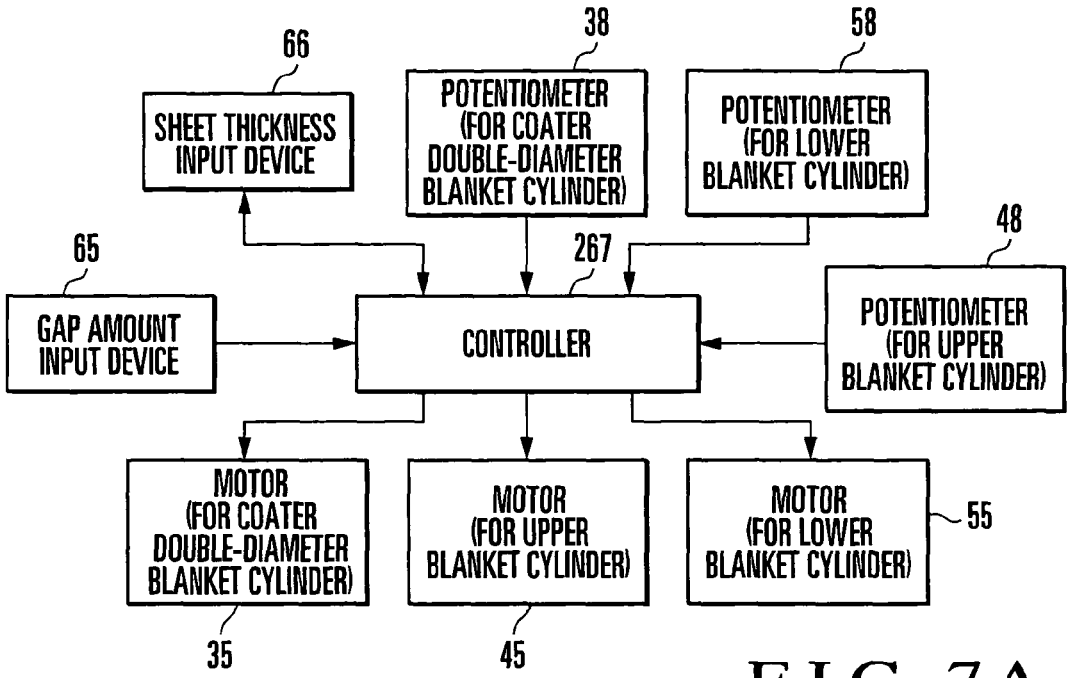
FIG. 7A is a block diagram showing the electrical arrangement of a sheet processing apparatus according to the first embodiment of the present invention.

As shown in FIG. 3, a motor 45 (second driving means) for the upper blanket cylinder is attached to the frames 34. As shown in FIG. 5, the motor 45 is connected to one end of a rod 47 through a gear train 46. When the motor 45 is driven in one direction, the rod 47 moves in the direction of an arrow C in FIG. 3 through the gear train 46. When the motor 45 is driven in the opposite direction, the rod 47 moves in the direction of an arrow D in FIG. 3 through the gear train 46. A potentiometer 48 for the upper blanket cylinder detects the current position of the upper blanket cylinder 25 and outputs it to the controller 267 (FIG. 7A). The controller 267 detects (calculates) a phase angle $\beta$ of the motor 45 on the basis of an output from the potentiometer 48.

As shown in FIG. 3, an almost L-shaped lever 49 is fixed to one end of a shaft 50 which is rotatably supported between the pair of frames 34. One end of the lever 49 is pivotally mounted on the other end of the rod 47, and its other end is pivotally mounted on one end of a rod 51. A lever (not shown) is fixed to the other end of the shaft 50. An end of the lever is pivotally mounted on one end of a rod (not shown). The other end of this rod is pivotally mounted on an eccentric bearing (to be described later) which rotatably supports the other end shaft of the upper blanket cylinder 25.

A pair of eccentric bearings 52 which rotatably support the two end shafts of the upper blanket cylinder 25 are fitted on the pair of frames 34. The other end of the rod 51 is pivotally mounted on the corresponding eccentric bearing 52. When the rod 47 moves in the direction of the arrow C and the lever 49 accordingly pivots counterclockwise about the shaft 50 as the center, the upper blanket cylinder 25 moves close to the coater double-diameter blanket cylinder 22 through the rod 51 and the corresponding eccentric bearing 52. This decreases the gap amount between the circumferential surfaces of the coater double-diameter blanket cylinder 22 and upper blanket cylinder 25.

When the rod 47 moves in the direction of the arrow D and the lever 49 accordingly pivots clockwise about the shaft 50 as the center, the upper blanket cylinder 25 separates from the coater double-diameter blanket cylinder 22 through the rod 51 and the corresponding eccentric bearing 52. This increases the gap amount between the circumferential surfaces of the coater double-diameter blanket cylinder 22 and upper blanket cylinder 25.

Figure 6:
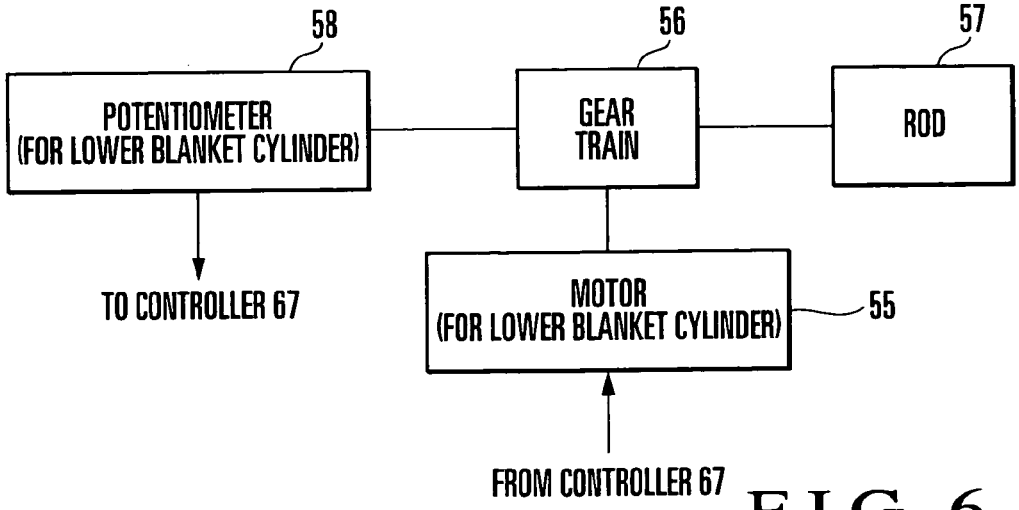
FIG. 6 is a view showing the connection state of the driving system of a motor for the lower blanket cylinder shown in FIG. 1.

As shown in FIG. 3, a motor 55 (third driving means) for the lower blanket cylinder is attached to the frames 34. As shown in FIG. 6, the motor 55 is connected to one end of a rod 57 through a gear train 56. When the motor 55 is driven in one direction, the rod 57 moves in the direction of an arrow E in FIG. 3 through the gear train 56. When the motor 55 is driven in the opposite direction, the rod 57 moves in the direction of an arrow F in FIG. 3 through the gear train 56. A potentiometer 58 for the lower blanket cylinder detects the current position of the lower blanket cylinder 29 and outputs it to the controller 267 (FIG. 7A). The controller 267 detects (calculates) a phase angle $\gamma$ of the motor 55 on the basis of an output from the potentiometer 58.

As shown in FIG. 3, an almost L-shaped lever 59 is fixed to one end of a shaft 60 which is rotatably supported between the pair of frames 34. One end of the lever 59 is pivotally mounted on the other end of the rod 57, and its other end is pivotally mounted on one end of a rod 61. A lever (not shown) is fixed to the other end of the shaft 60. An end of the lever is pivotally mounted on one end of a rod (not shown). The other end of this rod is pivotally mounted on an eccentric bearing (to be described later) which rotatably supports the other end shaft of the lower blanket cylinder 29.

A pair of eccentric bearings 62 which rotatably support the two end shafts of the lower blanket cylinder 29 are fitted on the pair of frames 34. The other end of the rod 61 is pivotally mounted on the corresponding eccentric bearing 62. When the rod 57 moves in the direction of the arrow E, the lever 59 pivots clockwise about the shaft 60 as the center. Thus, the lower blanket cylinder 29 moves toward the coater double-diameter blanket cylinder 22 through the rod 61 and the corresponding eccentric bearing 62. This increases the printing pressure between the coater double-diameter blanket cylinder 22 and lower blanket cylinder 29.

When the rod 57 moves in the direction of the arrow F, the lever 59 pivots counterclockwise about the shaft 50 as the center. Thus, the lower blanket cylinder 29 separates from the coater double-diameter blanket cylinder 22 through the rod 61 and the corresponding eccentric bearing 62. This decreases the printing pressure between the coater double-diameter blanket cylinder 22 and lower blanket cylinder 29.

The sheet processing apparatus according to this embodiment comprises, in addition to the potentiometers 38, 48, and 58 and motors 35, 45, and 55 described above, a controller 267 (control means), gap amount input device 65, and sheet thickness input device 66, as shown in FIG. 7A. The controller 267 is connected to the potentiometers 38, 48, and 58, motors 35, 45, and 55, gap amount input device 65, and sheet thickness input device 66. A gap amount t between the coater double-diameter blanket cylinder 22 and impression cylinder 10*b* is input to the gap amount input device 65, and the thickness of the sheet to be conveyed is input to the sheet thickness input device 66.

Figure 7B:
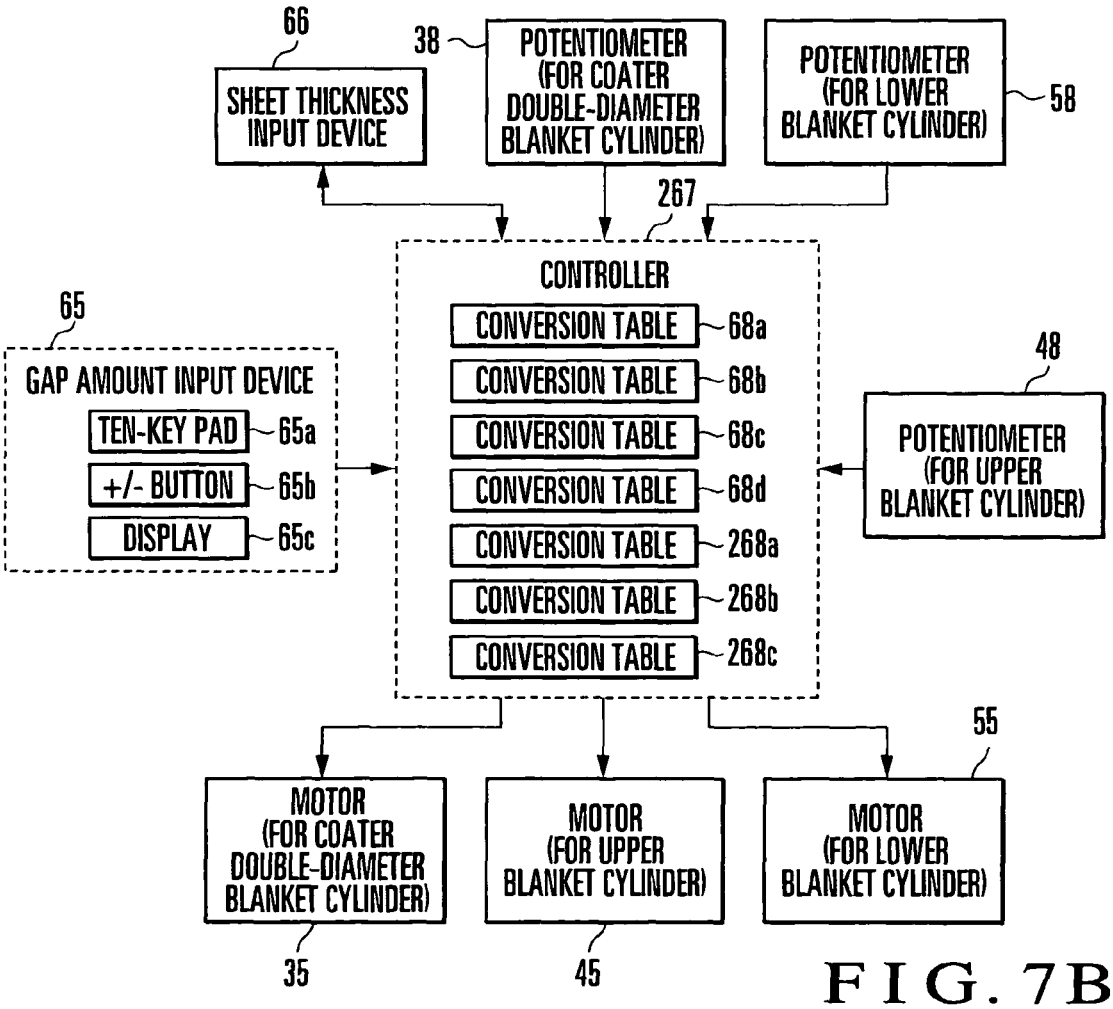
FIG. 7B is a block diagram of a controller and gap amount input device shown in FIG. 7A.
Figure 8A:
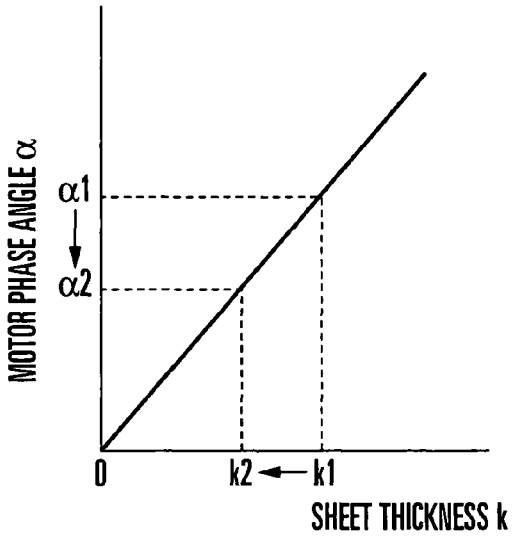
FIG. 8A is a graph defining the relationship "between a sheet thickness k and a motor phase angle $\alpha$" of the first conversion table shown in FIG. 7B.
Figure 8B:
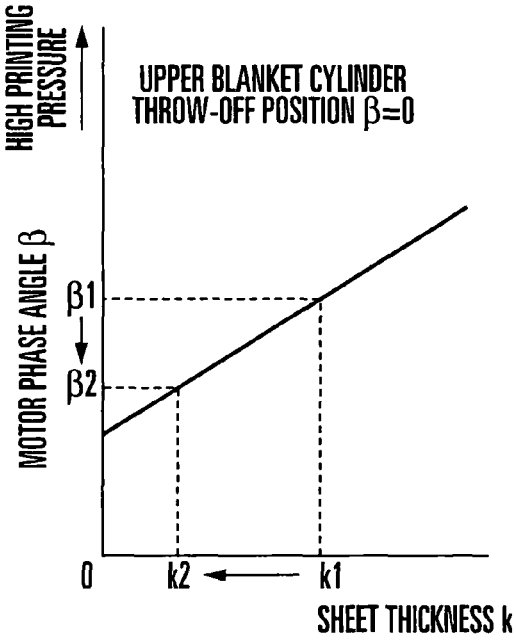
FIG. 8B is a graph defining the relationship "between the sheet thickness k and a phase angle $\beta$ of a motor 45" of the second conversion table shown in FIG. 7B.
Figure 8C:
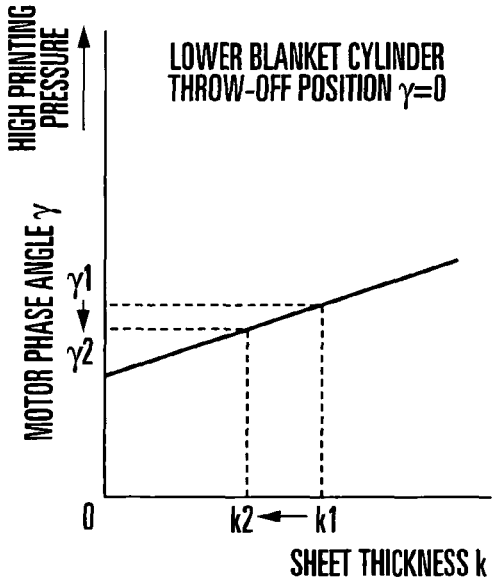
FIG. 8C is a graph defining the relationship "between the sheet thickness k and a phase angle $\gamma$ of a motor 55" of the third conversion table shown in FIG. 7B.
Figure 8D:
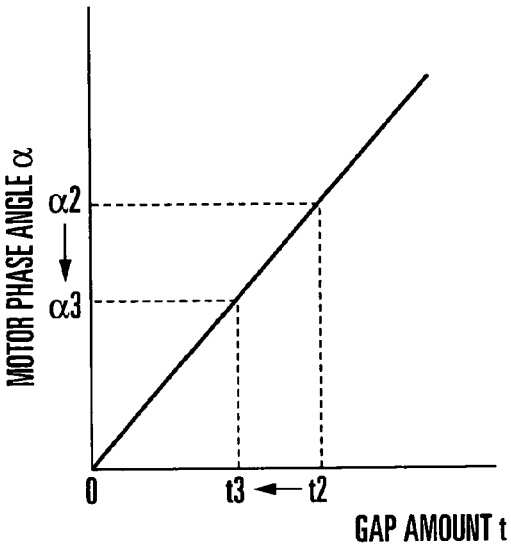
FIG. 8D is a graph defining the relationship "between a gap amount t and the phase angle $\alpha$ of a motor 35" of the fourth conversion table shown in FIG. 7B.
Figure 8E:
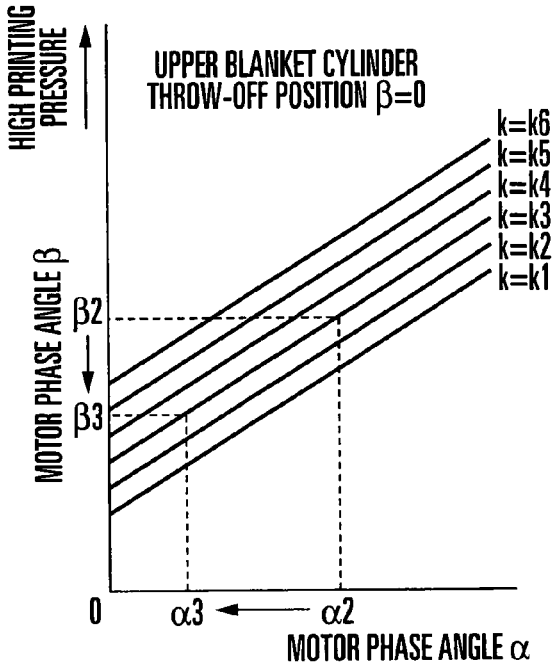
FIG. 8E is a graph defining the relationship "between the phase angle $\alpha$ of the motor 35 and the phase angle $\beta$ of the motor 45 with respect to the sheet thickness k" of the fifth conversion table shown in FIG. 7B.
Figure 8F:
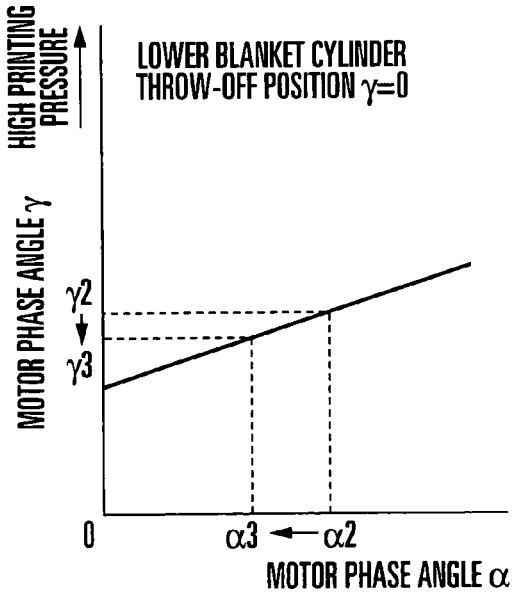
FIG. 8F is a graph defining the relationship "between the phase angle $\alpha$ of the motor 35 and the phase angle $\gamma$ of the motor 55" of the sixth conversion table shown in FIG. 7B.
Figure 8G:
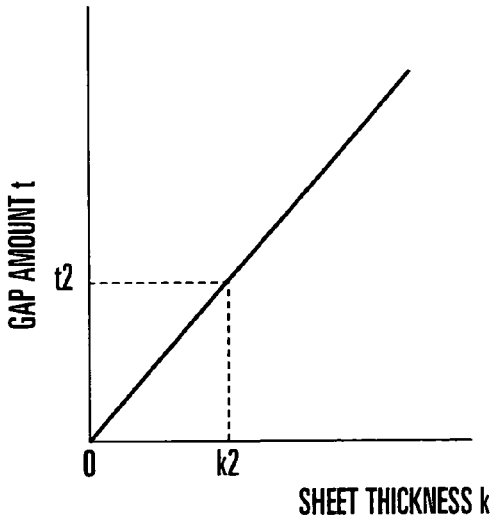
FIG. 8G is a graph defining the relationship "between the sheet thickness k and the gap amount t" of the seventh conversion table shown in FIG. 7B.

As shown in FIG. 7B, the controller 267 has a first conversion table 268*a* defining the relationship between "a sheet thickness k and the phase angle α of the motor 35" (FIG. 8A), a second conversion table 268*b* defining the relationship between "the sheet thickness k and the phase angle β of the motor 45" (FIG. 8B), a third conversion table 268*c* defining the relationship between "the sheet thickness k and the phase angle γ of the motor 55" (FIG. 8C), a fourth conversion table 68*a* defining the relationship between "the gap amount t and the phase angle α of the motor 35" (FIG. 8D), a fifth conversion table 68*b* defining the relationship between "the phase angle α of the motor 35 and the phase angle β of the motor 45 with respect to the sheet thickness k" (FIG. 8E), a sixth conversion table 68*c* defining the relationship between "the phase angle α of the motor 35 and the phase angle γ of the motor 55" (FIG. 8F), and a seventh conversion table 68*d* defining the relationship between "the sheet thickness k and the gap amount t" (FIG. 8G).

As shown in FIG. 7B, the gap amount input device 65 comprises a ten-key pad 65*a* to which the numerical value of the gap amount t is input, a +/− button 68*b* which changes (increases or decreases) the input (displayed) gap amount t, and a display 65*c* which displays the value of the input or changed gap amount t. The gap amount t to be displayed on the display 65*c* is input from the sheet thickness input device 66, ten-key pad 65*a*, and +/− button 65*b* which are manipulated by the operator. When the operator inputs the sheet thickness k from the key input device (not shown) of the sheet thickness input device 66, the controller 267 converts the sheet thickness k input from the sheet thickness input device 66 into the gap amount t by looking up the table 68*d*, and displays the gap amount t on the display 65*c*.

The controller 267 controls the phase angle α of the motor 35 on the basis of an output from the first conversion table 268*a*, corresponding to the sheet thickness k input from the sheet thickness input device 66, and the output from the potentiometer 38. The controller 267 controls the phase angle β of the motor 45 on the basis of an output from the second conversion table 268*b*, corresponding to the sheet thickness k input from the sheet thickness input device 266, and the output from the potentiometer 48. The controller 267 controls the phase angle γ of the motor 55 on the basis of an output from the third conversion table 268*c*, corresponding to the sheet thickness k input from the sheet thickness input device 66, and the output from the potentiometer 58. The controller 267 controls the phase angle α of the motor 35 on the basis of an output from the conversion table 68*a*, corresponding to a gap amount t2 input to the gap amount input device 65, and the output from the potentiometer 38. This finely adjusts the phase angle α. The controller 267 controls the phase angle β of the motor 45 on the basis of an output from the conversion table 68*b*, corresponding to a finely adjusted phase angle α2 of the motor 35 with respect to a sheet thickness k2 input to the sheet thickness input device 66, and the output from the potentiometer 48. This finely adjusts the phase angle β. The controller 267 controls the phase angle γ of the motor 55 on the basis of an output from the conversion table 68*c*, corresponding to the finely adjusted phase angle α2 of the motor 35, and the output from the potentiometer 58. This finely adjusts the phase angle γ.

The conversion tables concerning the phase angles of the respective motors 35, 45, and 55 will be described in detail with reference to FIGS. 8A to 8G. Upon reading the sheet thickness k=k1 from the sheet thickness input device 66, the controller 267 obtains a phase angle α1 of the motor 35 by looking up the conversion table 268*a*. When the sheet thickness is changed from k1 to k2, the controller 267 changes the phase angle of the motor 35 from α1 to α2 by looking up the conversion table 268*a*.

When the coater double-diameter blanket cylinder 22 is positionally adjusted as described above, the position of the upper blanket cylinder 25 is also adjusted to maintain the printing pressure between the coater double-diameter blanket cylinder 22 and upper blanket cylinder 25 obtained before position adjustment. The controller 267 obtains the phase angle β of the motor 45 from the sheet thickness k by looking up the conversion table 268*b*. When the sheet thickness k=k2, a phase angle β2 of the motor 45 is obtained from the conversion table 268*b*.

As the sheet thickness is changed from k1 to k2, the phase angle of the motor 45 is also changed from β1 to β2. In this manner, when the phase angle of the motor 35 is changed to α2 and the phase angle of the motor 45 is changed to β2, the printing pressure between the coater double-diameter blanket cylinder 22 and upper blanket cylinder 25 which is obtained after the change is set to be equal to that obtained before the change.

When the coater double-diameter blanket cylinder 22 is positionally adjusted as described above, the position of the lower blanket cylinder 29 is also adjusted to maintain the printing pressure between the coater double-diameter blanket cylinder 22 and lower blanket cylinder 29 obtained before position adjustment. The controller 267 obtains the phase angle γ of the motor 55 from the sheet thickness k by looking up the conversion table 268*c*. More specifically, when the sheet thickness k is k2, a phase angle γ2 of the motor 55 is obtained from the conversion table 268*c*.

As the sheet thickness is changed from k1 to k2, the phase angle of the motor 55 is also changed from γ1 to γ2. In this manner, when the phase angle of the motor 35 is changed to α2 and the phase angle of the motor 55 is changed to γ2, the printing pressure between the coater double-diameter blanket cylinder 22 and lower blanket cylinder 29 which is obtained after the change is set to be equal to that obtained before the change.

Figure 9A:
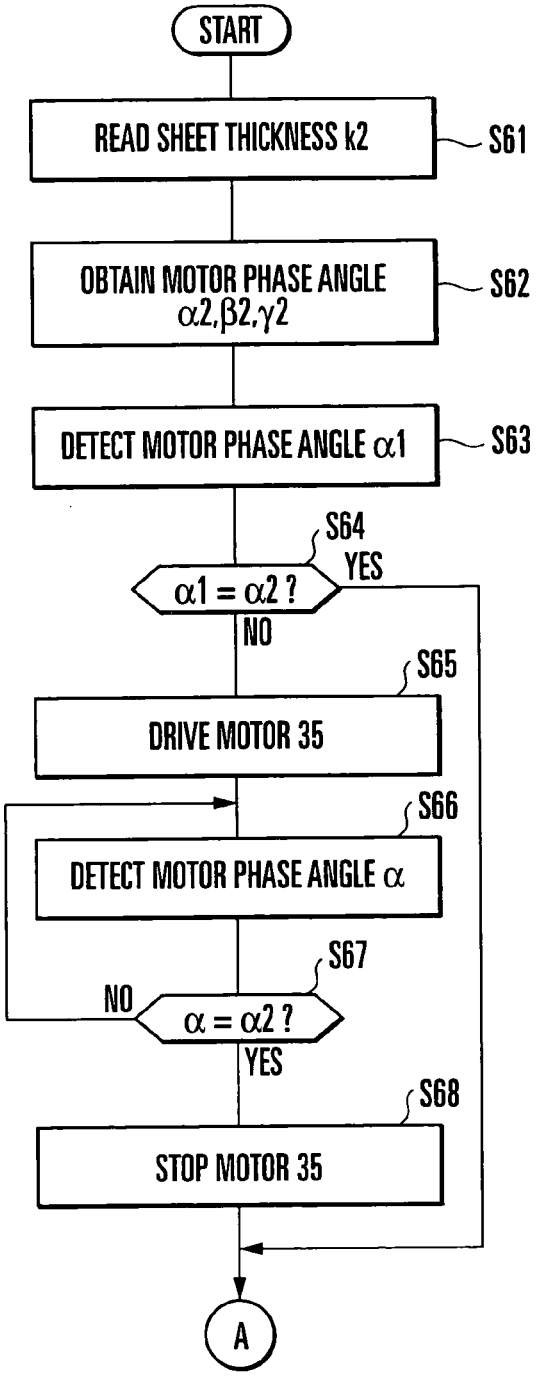
FIGS. 9A to 9C are flowcharts for explaining the operation of adjusting the gap amount t and the operation of controlling printing pressures between respective cylinders in the sheet processing apparatus shown in FIG. 7A.
Figure 9B:
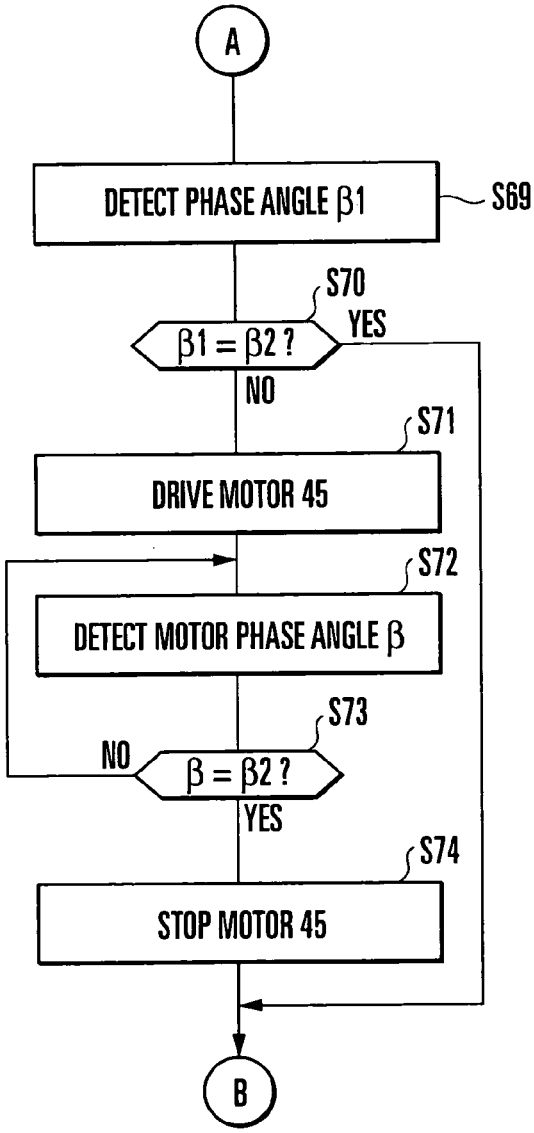
Figure 9C:
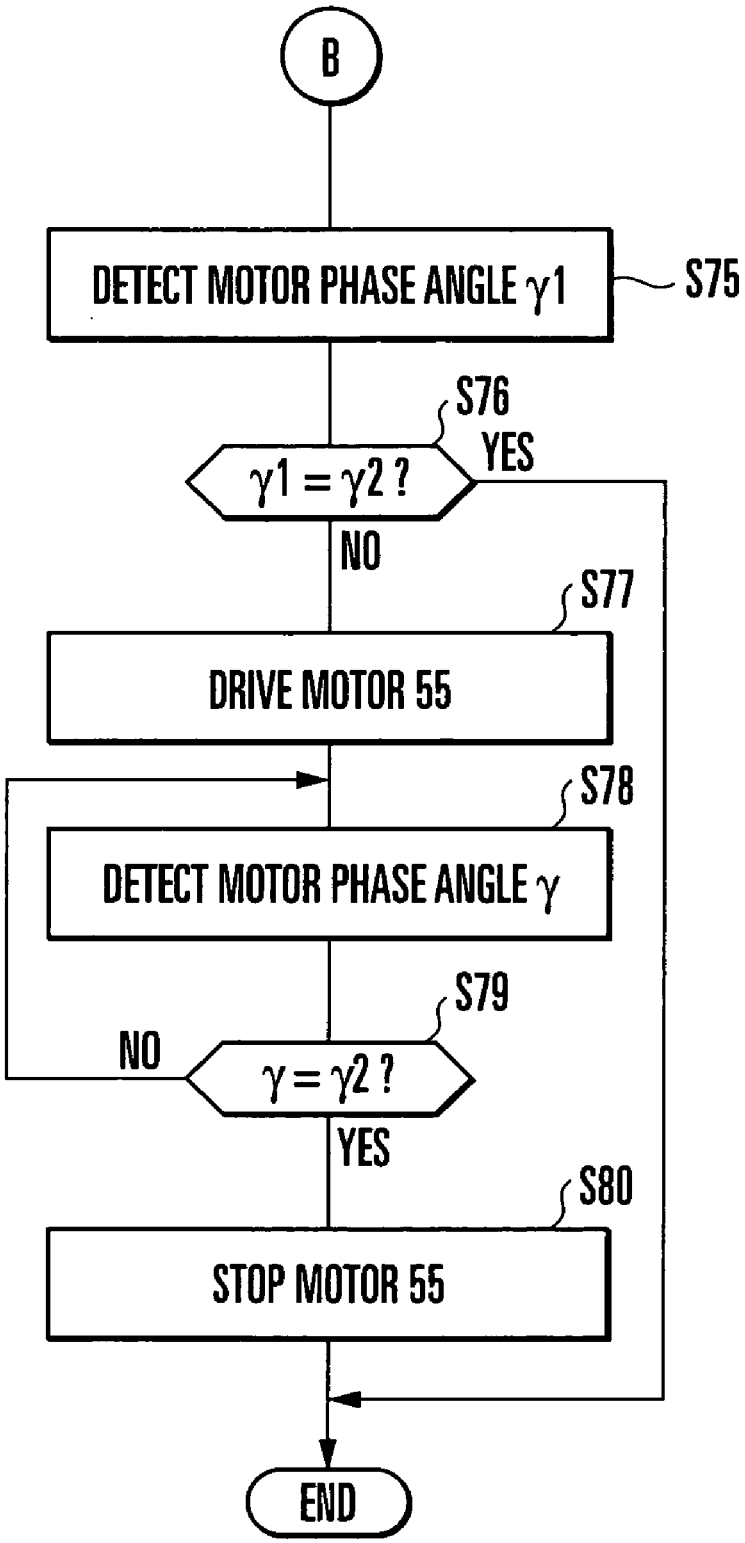

Adjustment and control operation in the first embodiment in which the sheet thickness is changed from k1 to k2 will be described with reference to FIGS. 9A to 9C. The controller 267 reads the changed sheet thickness k2 from the sheet thickness input device 66 (step S61). The controller 267 obtains the phase angle $\alpha 2$ of the motor 35 from the sheet thickness k2 by looking up the conversion table 268*a* (step S62). The controller 267 then detects the current phase angle $\alpha 1$ of the motor 35 on the basis of the output from the potentiometer 38 (step S63).

Then, the phase angles $\alpha 1$ and $\alpha 2$ are compared (step S64). If $\alpha 1=\alpha 2$, the phase angle $\alpha$ of the motor 35 is the phase angle $\alpha 2$ obtained from the sheet thickness k2. Thus, the motor 35 is not driven, and the process advances to step S69.

If NO in step S64, the motor 35 is driven (step S65). The current phase angle $\alpha$ of the motor 35 is detected on the basis of the output from the potentiometer 38 (step S66). If $\alpha=\alpha 2$ (YES in step S67), the motor 35 is stopped (step S68). Thus, the coater double-diameter blanket cylinder 22 is adjusted to the position corresponding to the sheet thickness k2.

The controller 267 then detects the current phase angle $\beta 1$ of the motor 45 on the basis of the output from the potentiometer 48 (step S69). The current phase angle $\beta 1$ of the motor 45 is compared with the phase angle $\beta 2$ of the motor 45 which is obtained from the sheet thickness k=k2 (step S70). If $\beta 1=\beta 2$, the phase angle $\beta$ of the motor 45 is the phase angle $\beta 2$ obtained from the sheet thickness k2. Thus, the motor 45 is not driven, and the process advances to step S75.

If NO in step S70, the motor 45 is driven (step S71). The current phase angle $\beta$ of the driven motor 45 is detected on the basis of the output from the potentiometer 48 (step S72). If $\beta=\beta 2$ (YES in step S73), the motor 45 is stopped (step S74). Thus, the upper blanket cylinder 25 is positionally adjusted to maintain its printing pressure with respect to the coater double-diameter blanket cylinder 22 which is obtained before position adjustment.

The controller 267 then detects the current phase angle $\gamma 1$ of the motor 55 on the basis of the output from the potentiometer 58 (step S75). The current phase angle $\gamma 1$ of the motor 55 is compared with the phase angle $\gamma 2$ of the motor 55 which is obtained from the sheet thickness k2 (step S76). If $\gamma 1=\gamma 2$, the phase angle $\gamma$ of the motor 55 is the phase angle $\gamma 2$ obtained from the phase angle $\alpha 2$ of the motor 35. Thus, the motor 55 is not driven, and the control operation is ended.

If NO in step S76, the motor 55 is driven (step S77). The controller 267 detects the current phase angle $\gamma$ of the driven motor 55 on the basis of the output from the potentiometer 58 (step S78). If $\gamma=\gamma 2$ (YES in step S79), the motor 55 is stopped (step S80).

If $\gamma=\gamma 2$ is not obtained (NO in step S79), the motor 55 is kept driven, and steps S78 and S79 are repeated until $\gamma=\gamma 2$ is obtained. This positionally adjusts the lower blanket cylinder 29 to maintain its printing pressure with respect to the coater double-diameter blanket cylinder 22 which is obtained before position adjustment.

As described above, the conversion tables 268*a*, 268*b*, and 268*c* adjust the position of the coater double-diameter blanket cylinder 22 with respect to the impression cylinder 10*b* and the positions of the upper blanket cylinder 25 and lower blanket cylinder 29 with respect to the coater double-diameter blanket cylinder 22 in accordance with the change of the sheet thickness k. Even if the positions of the cylinders 22, 25, and 29 are set in this manner, depending on the conditions of the sheet such as the sheet quality, the conditions of the printing press such as the printing speed, and the environmental conditions such as the temperature or humidity, a scratch may be formed on the sheet when transferring the sheet from the impression cylinder 10*b* to the coater double-diameter blanket cylinder 22. In this case, to prevent a scratch, the gap amount between the impression cylinder 10*b* and coater double-diameter blanket cylinder 22 is changed from t2 to t3. The change to the gap amount t3 is performed by changing the phase angle of the motor 35 from $\alpha 2$ to $\alpha 3$. An example will be described hereinafter in which the gap amount t is changed in the decreasing direction as a measure to take when a scratch is formed. The gap amount t may also be changed in the increasing direction. When adjusting the gap amount t, it is increased or decreased selectively in accordance with the conditions of the sheet such as the sheet quality or the location of the scratch.

The position of the coater double-diameter blanket cylinder 22 which is set based on the sheet thickness k is finely adjusted. This fine adjustment is performed by finely adjusting the gap amount t between the coater double-diameter blanket cylinder 22 and impression cylinder 10*b*. The phase angle $\alpha$ which is finely adjusted on the basis of the finely adjusted gap amount t input from the gap amount input device 65 is obtained, and the motor 35 is controlled by fine adjustment. The phase angle $\beta$ which is finely adjusted on the basis of the finely adjusted phase angle $\alpha$ and the sheet thickness k is obtained, and the motor 45 is controlled. The phase angle $\gamma$ is obtained on the basis of the finely adjusted phase angle $\alpha$, and the motor 55 is controlled.

Figure 10:
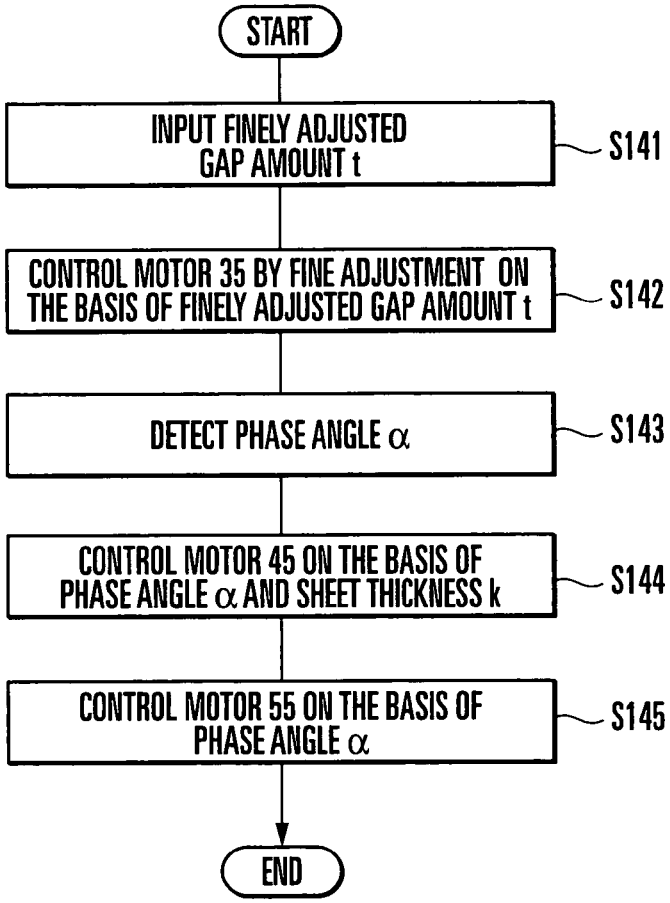
FIG. 10 is a flowchart for explaining the operation of finely adjusting the gap amount t in the sheet processing apparatus shown in FIG. 7A.

The operation of finely adjusting the gap amount t will be described with reference to FIG. 10. The operator manipulates the ten-key pad 65*a* or +/− button 65*b* to input the finely adjusted gap amount t (step S141). The controller 267 obtains the phase angle $\alpha$ of the motor 35 from the finely adjusted input gap amount t by looking up the conversion table 68*a*, and controls the motor 35 by fine adjustment on the basis of the obtained phase angle $\alpha$ (step S142). The controller 267 then detects the phase angle $\alpha$ of the finely adjusted motor 35 from the output from the potentiometer 38 (step S143). The gap amount t is obtained from the detected phase angle $\alpha$ by looking up the conversion table 68*a*. The display 65*c* displays the obtained gap amount t.

Subsequently, the controller 267 obtains the phase angle $\beta$ of the motor 45 from the phase angle $\alpha$ after fine adjustment detected by the potentiometer 38 and from the sheet thickness k input to the sheet thickness input device 66 by looking up the conversion table 68*b*, and controls the motor 45 by fine adjustment on the basis of the obtained phase angle $\beta$ (step S144). The controller 267 then obtains the phase angle $\gamma$ of the motor 55 from the phase angle $\alpha$ after fine adjustment detected by the potentiometer 38 by looking up the conversion table 68*c*, and controls the motor 55 by fine adjustment on the basis of the obtained phase angle $\gamma$ (step S145). Thus, the printing pressures of the two blanket cylinders 25 and 29 with respect to the coater double-diameter blanket cylinder 22 can be maintained at the same values as those obtained before fine adjustment.

Figure 19:
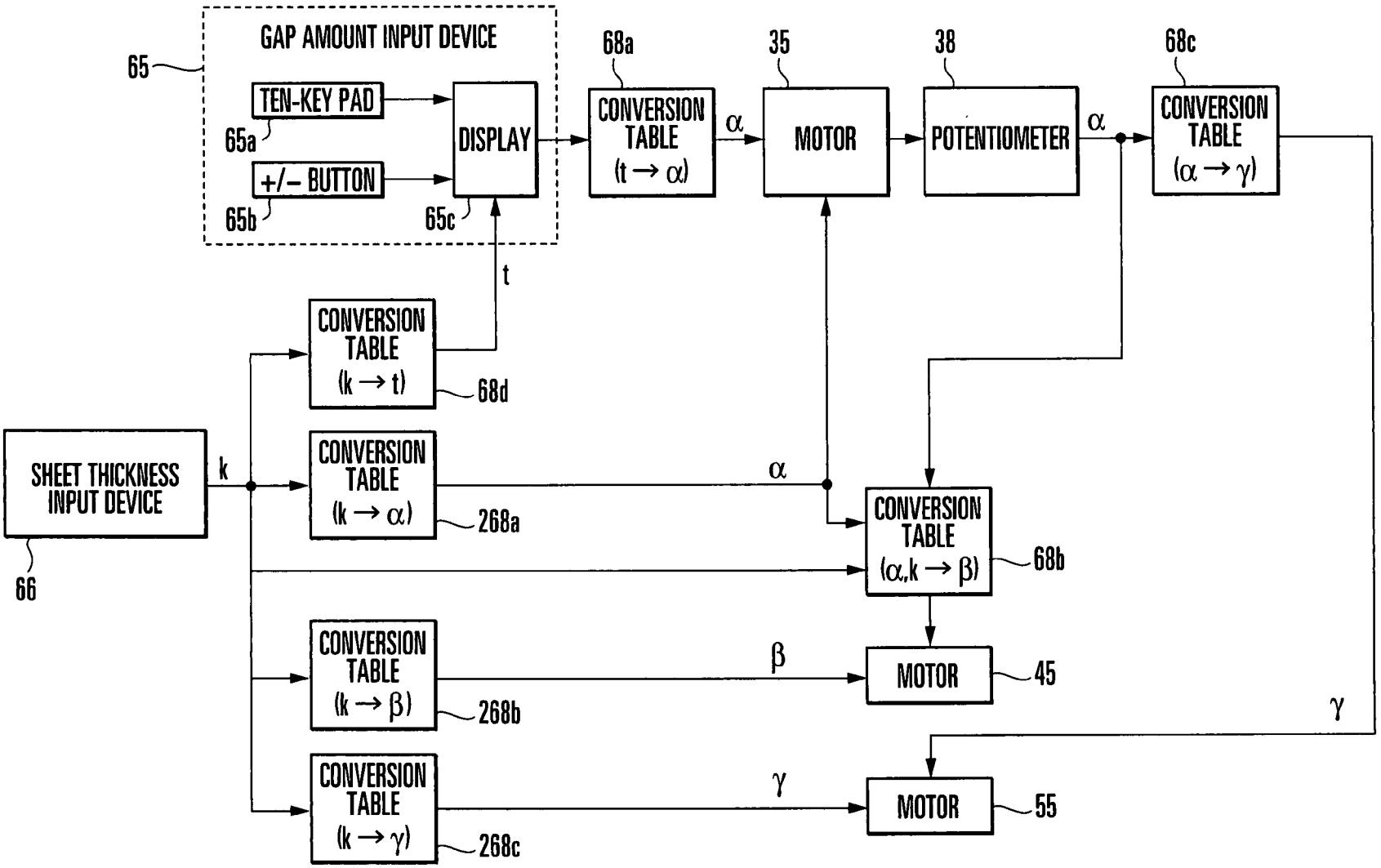
FIG. 19 is a diagram showing a data sequence in the sheet processing apparatus according to the first embodiment of the present invention.

The data sequence of this embodiment will be described with reference to FIG. 19. In FIG. 19, the solid lines represent data sequence for main adjustment, and thin lines represent data sequence for fine adjustment. First, the sheet thickness k is input to the sheet thickness input device 66. In the conversion table 68*d*, the sheet thickness k input to the sheet thickness input device 66 is converted into the gap amount t. The display 65*c* of the gap amount input device 65 displays the obtained gap amount t. Meanwhile, the gap amount t is directly input from the ten-key pad 65*a* of the gap amount input device 65, or is changed by manipulation of the +/− button 65*b*, to finely adjust the gap amount t obtained by conversion from the sheet thickness k. The display 65*c* displays the gap amount t input by the ten-key pad 65*a* or changed by the +/− button 65*b*.

In the conversion tables 268*a*, 268*b*, and 268*c*, the phase angles $\alpha$, $\beta$, and $\gamma$ are obtained from the sheet thickness k input to the sheet thickness input device 66. The motors 35, 45, and 55 are driven to have the phase angles α, β, and γ obtained from the conversion tables 268*a*, 268*b*, and 268*c*.

In the conversion table 68*a*, the phase angle α for fine adjustment is obtained from the gap amount t finely adjusted by the gap amount input device 65. The motor 35 is driven by fine adjustment to have the phase angle α obtained from the conversion table 68*a*. In the conversion table 68*b*, the phase angle β for fine adjustment is obtained from the phase angle α of the motor 35 after finely adjustment which is detected by the potentiometer 38 and the sheet thickness k input to the sheet thickness input device 66. The motor 45 is driven by fine adjustment to have the phase angle β obtained from the conversion table 68*b*. In the conversion table 68*c*, the phase angle γ for fine adjustment is obtained from the phase angle α of the motor 35 after finely adjustment which is detected by the potentiometer 38. The motor 55 is driven by fine adjustment to have the phase angle γ obtained from the conversion table 68*c*.

Figure 11:
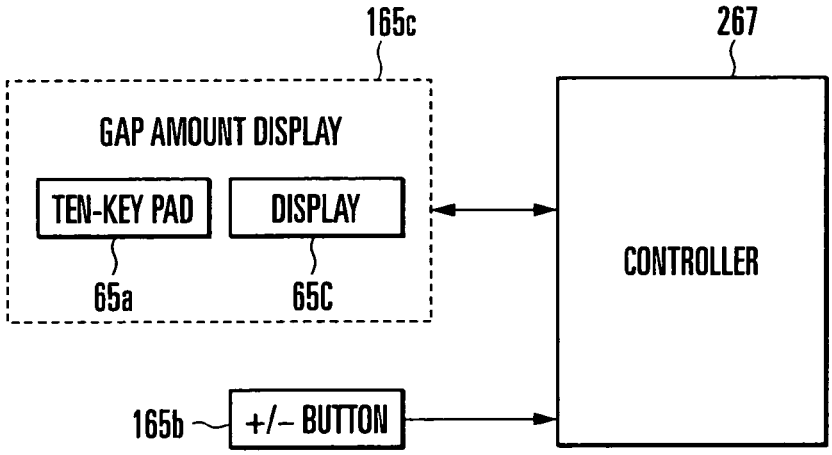
FIG. 11 is a block diagram of the main part showing the electrical arrangement of a sheet processing apparatus according to the second embodiment of the present invention.
Figure 12:
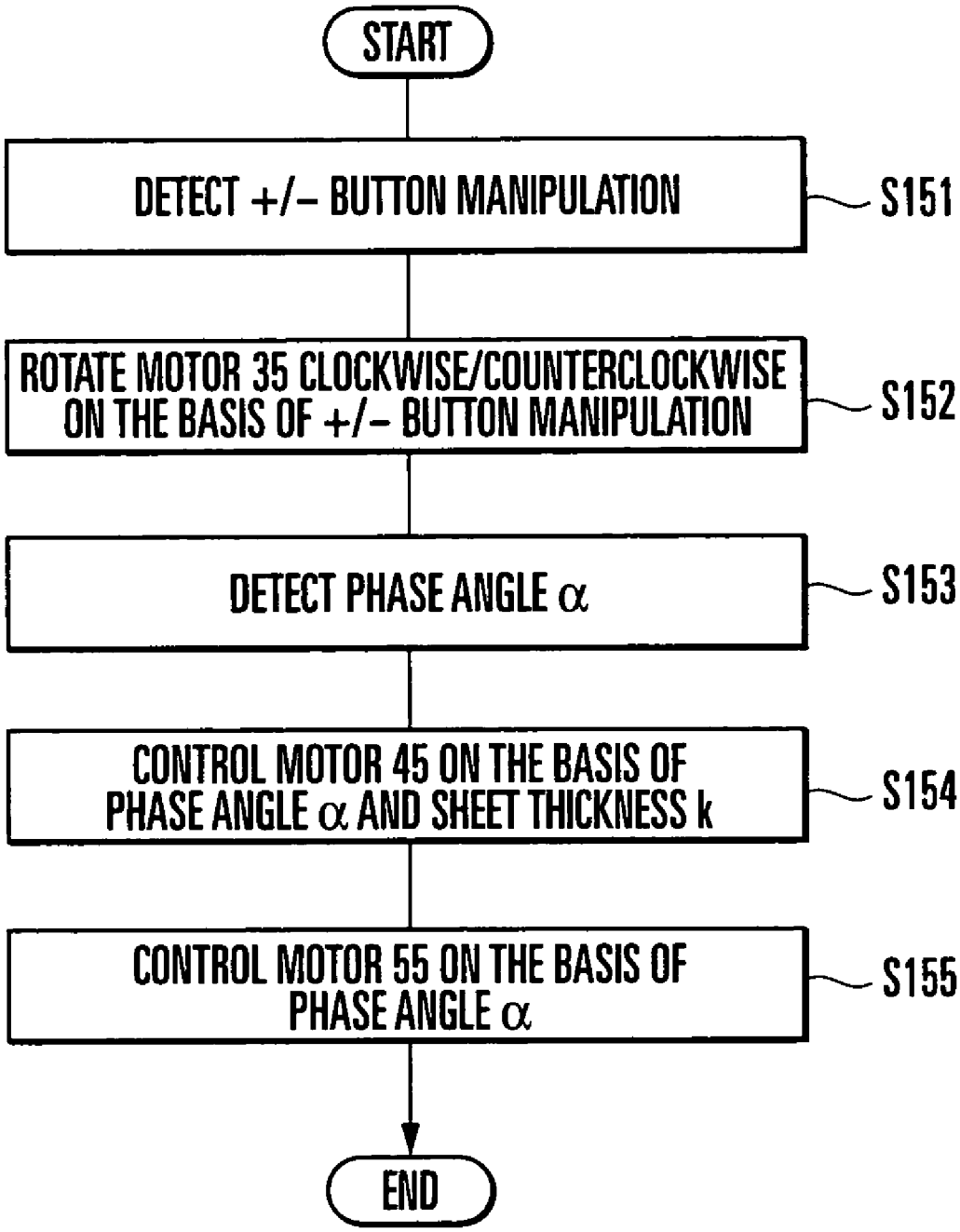
FIG. 12 is a flowchart for explaining the operation of adjusting the gap amount t and the operation of controlling printing pressures between respective cylinders in the sheet processing apparatus shown in FIG. 11

The second embodiment of the present invention will be described with reference to FIGS. 11 and 12. The second embodiment is different from the first embodiment (FIG. 7B) in that a +/− button 165*b* and gap amount display 165*c* are provided in place of the gap amount input device 65. This makes the fine adjustment operation for the motors to be different from that of the first embodiment. Except for this, the arrangement and operation sequence of this embodiment are the same as those of the first embodiment, and a repeated explanation will be omitted.

The gap amount display 165*c* displays a gap amount t input from a controller 267. In response to the manipulation, the +/− button 165*b* directly instructs the controller 267 to rotate a motor 35 clockwise/counterclockwise. The controller 267 detects the manipulation of the +/− button 165*b* as shown in FIG. 12 (step S151). In response to the detected +/− button manipulation, the controller 267 rotates the motor 35 clockwise/counterclockwise to control it by fine adjustment (step S152).

The controller 267 then detects a phase angle α after fine adjustment from an output from a potentiometer 38 (step S153). The finely adjusted gap amount t is obtained on the basis of the phase angle α after fine adjustment. The controller 267 controls the gap amount display 165*c* to display the obtained gap amount t. The controller 267 then performs operations in steps S154 and S155 corresponding to steps S144 and S145 in FIG. 10, thus controlling motors 45 and 55 by fine adjustment. Thus, the printing pressures of two blanket cylinders 25 and 29 with respect to a coater double-diameter blanket cylinder 22 can be maintained at the same values as those which are obtained before fine adjustment.

The third embodiment of the present invention will be described with reference to FIGS. 13 to 15D. According to this embodiment, the driving amount of the motor 45 is controlled by adding the amount of printing pressure adjustment of the motor 45, which accompanies adjustment of the printing pressure between a coater double-diameter blanket cylinder 22 and upper blanket cylinder 25 that takes place before the gap amount adjustment, to the driving amount of a motor 45 obtained on the basis of a sheet thickness k which is input to a sheet thickness input device 66. The driving amount of a motor 55 is controlled by adding the amount of printing pressure adjustment of the motor 55, which accompanies adjustment of the printing pressure between the coater double-diameter blanket cylinder 22 and a lower blanket cylinder 29 that takes place before gap amount adjustment, to the driving amount of the motor 55 obtained on the basis of the sheet thickness k which is input to the sheet thickness input device 66.

Figure 13:
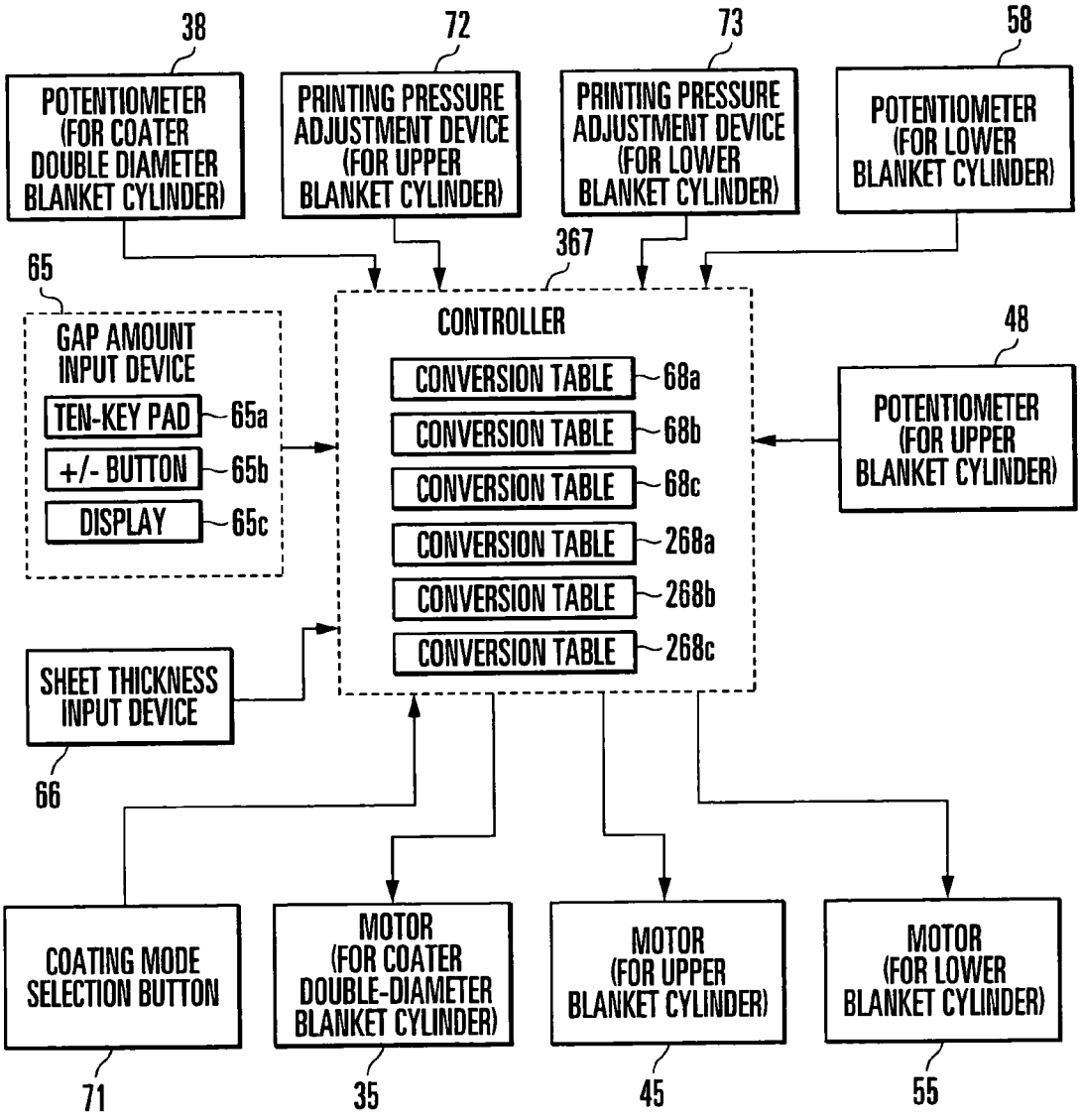
FIG. 13 is a block diagram of the main part showing the electrical arrangement of a sheet processing apparatus according to the third embodiment of the present invention.

As shown in FIG. 13, this embodiment further comprises a coating mode selection button 71, a printing pressure adjustment device 72 for the upper blanket cylinder, and a printing pressure adjustment device 73 for the lower blanket cylinder, in addition to the arrangement of the first embodiment. The coating mode selection button 71 (coating mode selection means) performs selection among double-sided coating, reverse coating, and obverse coating. The printing pressure adjustment device 72 drives the motor 45 by a manual operation to adjust the printing pressure between the coater double-diameter blanket cylinder 22 and upper blanket cylinder 25. The printing pressure adjustment device 73 drives the motor 55 by a manual operation to adjust the printing pressure between the coater double-diameter blanket cylinder 22 and lower blanket cylinder 29.

Figure 14A:
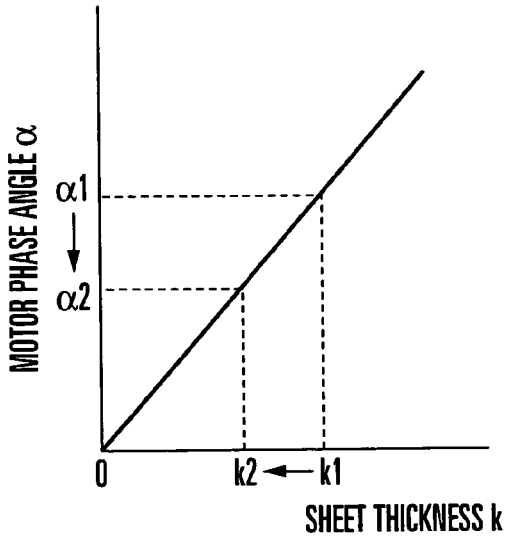
FIG. 14A is a graph defining the relationship "between a sheet thickness k and motor phase angle α" of the first conversion table shown in FIG. 13.
Figure 14B:
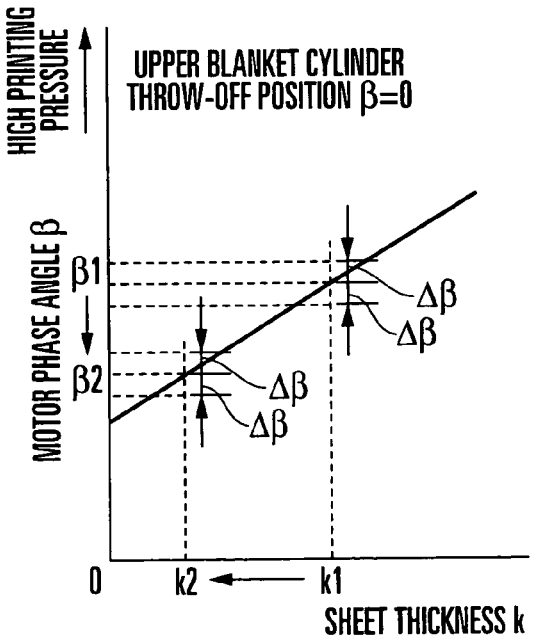
FIG. 14B is a graph defining the relationship "between the sheet thickness k and a phase angle β of a motor 45" of the second conversion table shown in FIG. 13.
Figure 14C:
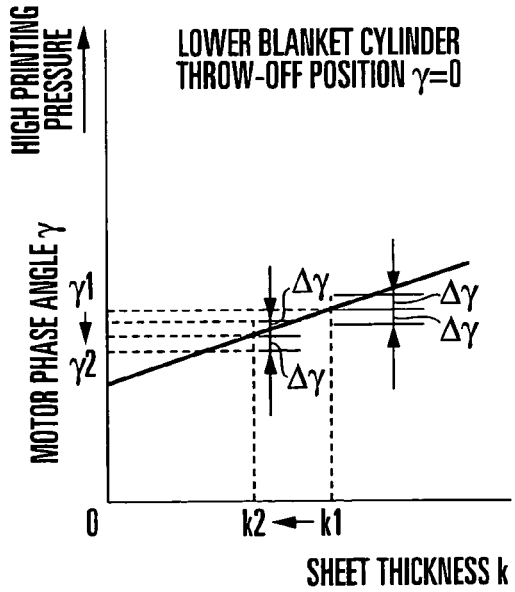
FIG. 14C is a graph defining the relationship "between the sheet thickness k and a motor phase angle γ of a motor 55" of the third conversion table shown in FIG. 13.
Figure 14D:
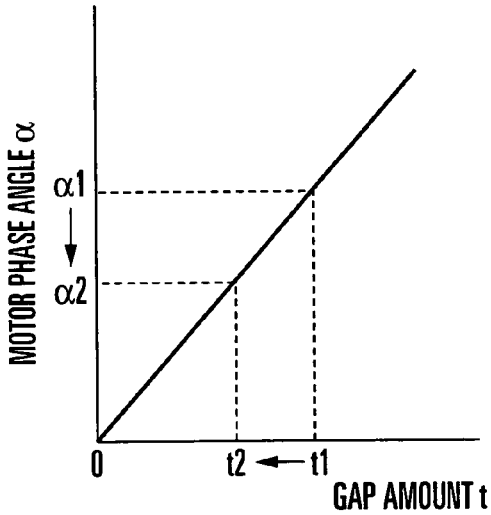
FIG. 14D is a graph defining the relationship "between a gap amount t and the phase angle α of a motor 35" of the fourth conversion table shown in FIG. 13.
Figure 14E:
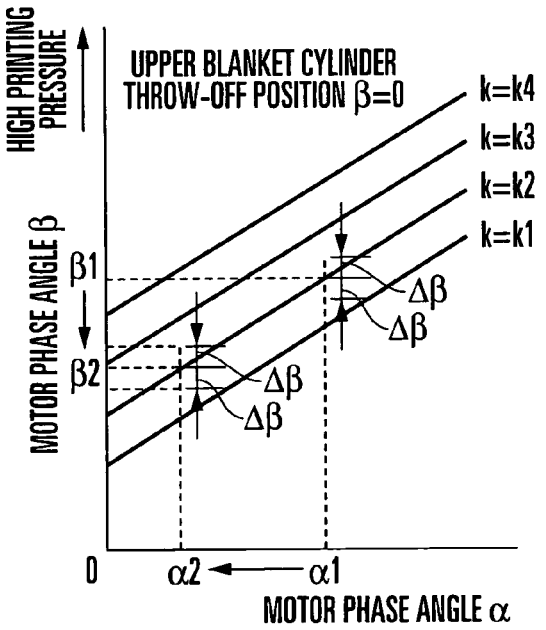
FIG. 14E is a graph defining the relationship "between the phase angle α of the motor 35 and the phase angle β of the motor 45 with respect to the sheet thickness k" of the fifth conversion table shown in FIG. 13.
Figure 14F:
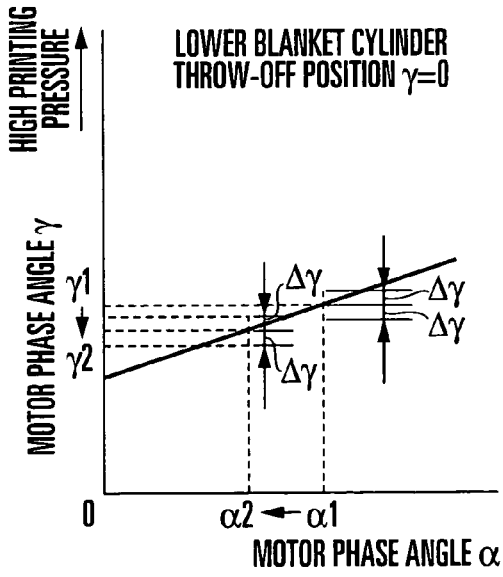
FIG. 14F is a graph defining the relationship "between the phase angle α of the motor 35 and the phase angle γ of the motor 55" of the sixth conversion table shown in FIG. 13.
Figure 15A:
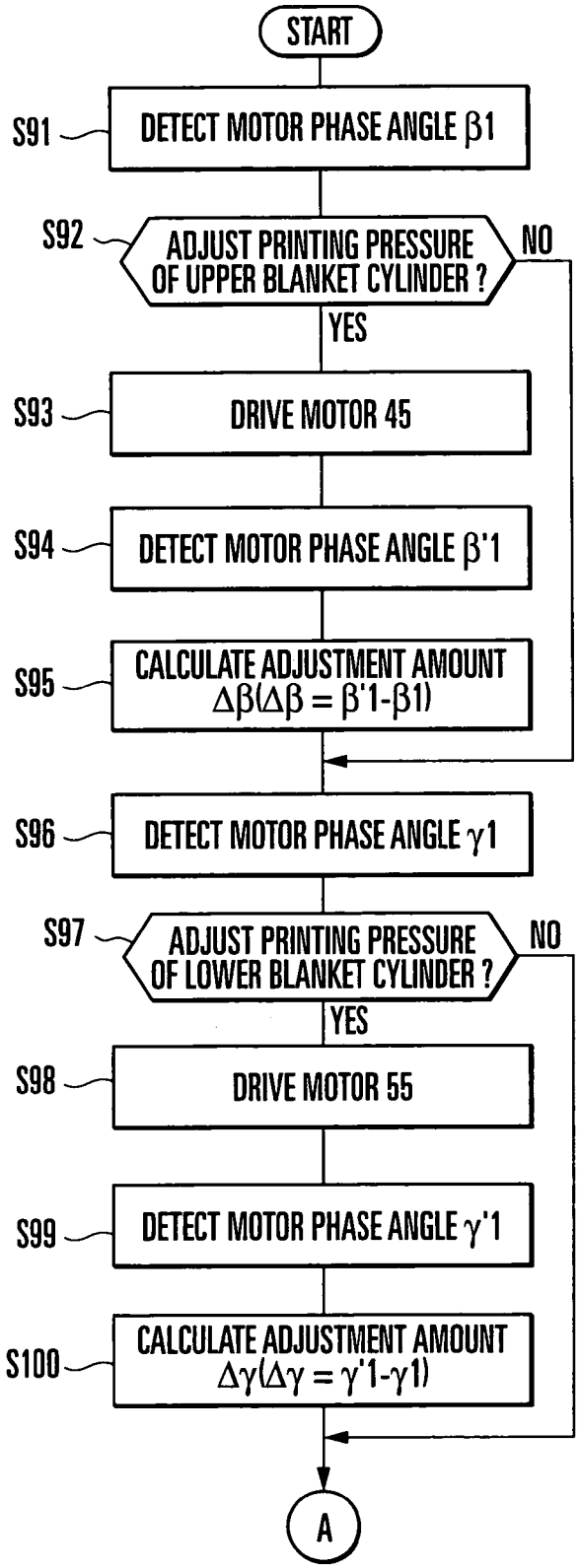
FIGS. 15A to 15D are flowcharts for explaining the operation of adjusting a gap amount t and the operation of controlling printing pressures between respective cylinders in the sheet processing apparatus shown in FIG. 13.
Figure 15B:
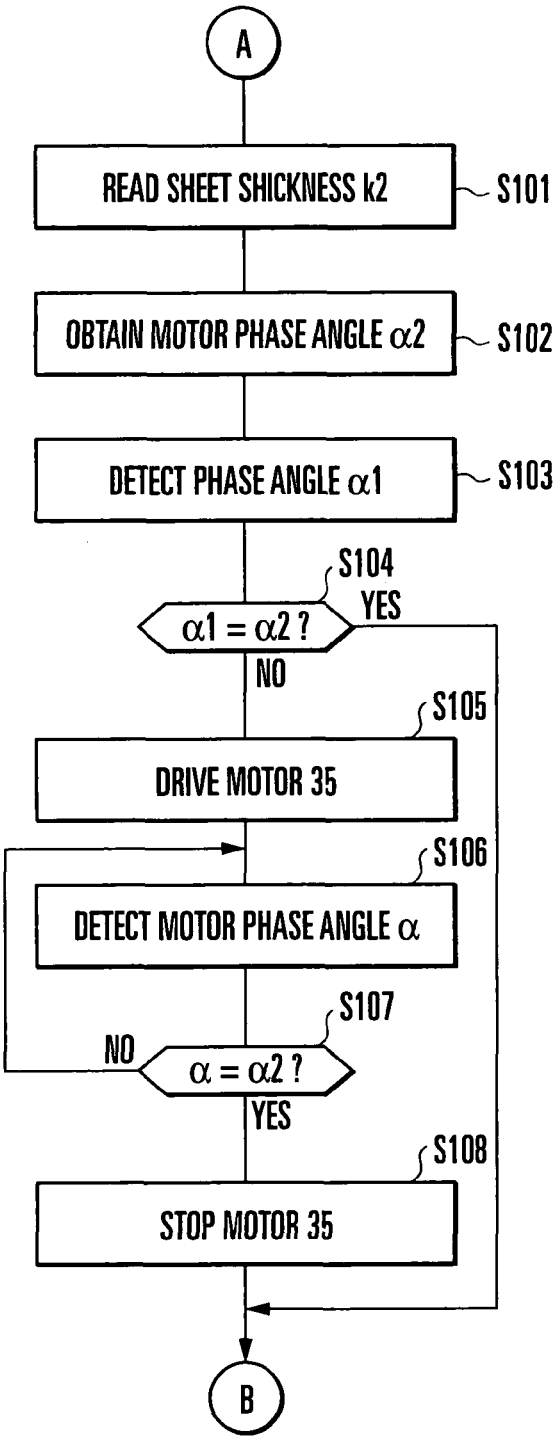
Figure 15C:
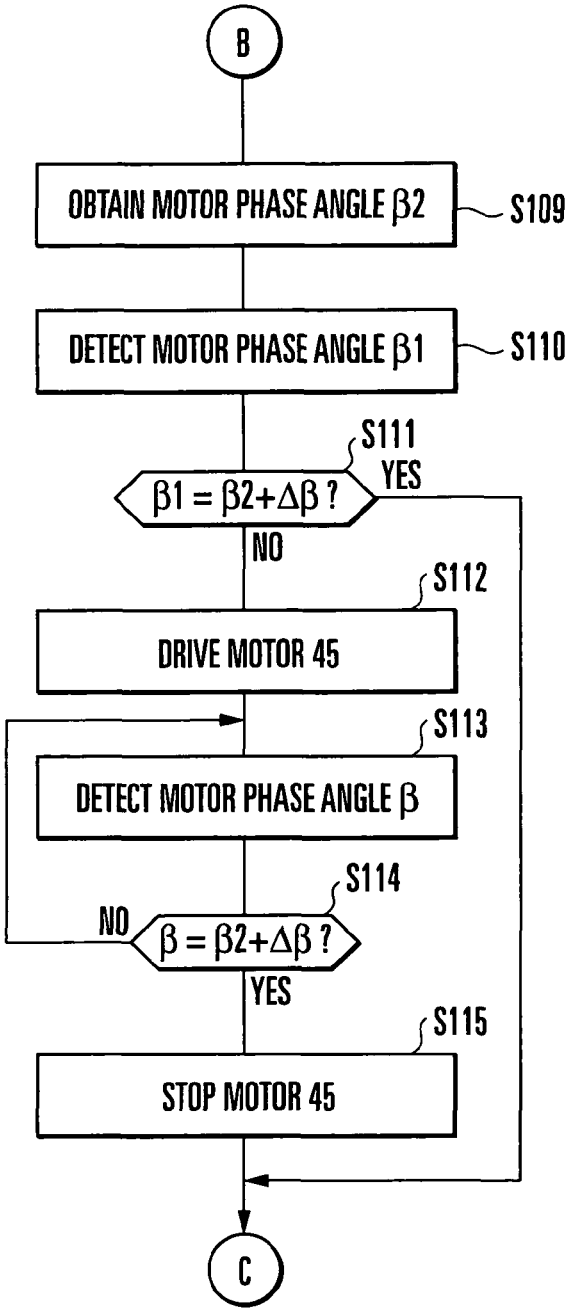
Figure 15D:
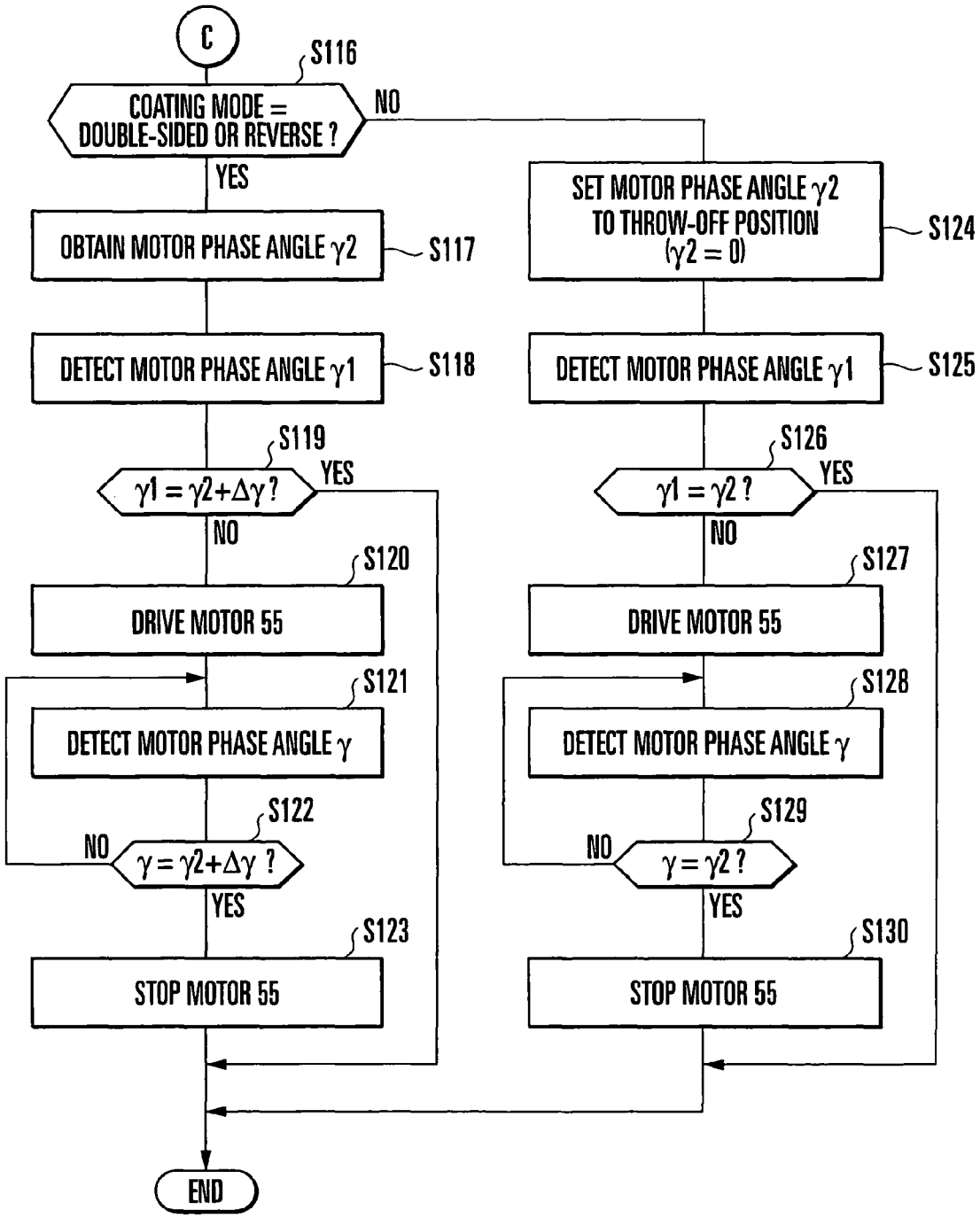

A controller 367 has a first conversion table 268*a* defining the relationship "between the sheet thickness k and a phase angle α of the motor 35" (FIG. 14A), a second conversion table 268*b* defining the relationship "between the sheet thickness k and a phase angle β of the motor 45" (FIG. 14B), a third conversion table 268*c* defining the relationship "between the sheet thickness k and a phase angle γ of the motor 55" (FIG. 14C), a fourth conversion table 68*a* defining the relationship "between a gap amount t and the phase angle α of the motor 35" (FIG. 14D), a fifth conversion table 68*b* defining the relationship "between the phase angle α of the motor 35 and the phase angle β of the motor 45 with respect to the sheet thickness k" (FIG. 14E), and a sixth conversion table 68*c* defining the relationship "between the phase angle α of the motor 35 and the phase angle γ of the motor 55" (FIG. 14F).

The controller 367 obtains the phase angle α of the motor 35 from the sheet thickness k input to the sheet thickness input device 66 by looking up the conversion table 268*a*. The controller 367 obtains the phase angle β of the motor 45 from the sheet thickness k input to the sheet thickness input device 66 by looking up the conversion table 268*b*. At this time, the controller 367 adds (by addition or subtraction) an amount corresponding to a printing pressure adjustment amount Δβ, which is adjusted by the printing pressure adjustment device 72 when the motor 45 has a phase angle β1, to a phase angle β2 obtained after adjustment.

More specifically, when the sheet thickness before the change satisfies k=k1, the phase angle β1 of the motor 45 is temporarily obtained by looking up the conversion table 268*b*. At this time, when the printing pressure adjustment device 72 adjusts the printing pressure, the potentiometer 48 detects the phase angle β'1 of the motor 45 after the printing pressure adjustment, and the printing pressure adjustment amount Δβ is obtained on the basis of the phase angles β'1 and β1. Subsequently, when the sheet thickness is changed from k1 to k2, the phase angle β2 of the motor 45 is temporarily obtained. The printing pressure adjustment amount Δβ obtained before the change is added to the temporarily obtained phase angle β2, thus obtaining a phase angle (β2+Δβ).

If the phase angle (β2+Δβ) is adjusted by Δβ in a direction to decrease the printing pressure, Δβ has a negative value, and accordingly a phase angle obtained by subtracting Δβ from β2 is obtained. If the phase angle (β2+Δβ) is adjusted by Δβ in a direction to increase the printing pressure, Δβ has a positive value, and accordingly a phase angle obtained by adding Δβ to β2 is obtained.

In this manner, upon the change of the sheet thickness input to the sheet thickness input device 65 from k1 to k2, the phase angle of the motor 45 is changed from β1 to β2. At this time, the printing pressure adjustment amount which is adjusted before the change is added to the printing press between the coater double-diameter blanket cylinder 22 and upper blanket cylinder 25 which is obtained after the change, thus maintaining the printing pressure in the same state.

The controller 367 obtains the phase angle γ of the motor 55 from the sheet thickness k input to the sheet thickness input device 66 by looking up the conversion table 268*c*. At this time, the controller 367 adds a printing pressure adjustment amount Δγ, which is obtained by adjusting a phase angle γ1 of the motor 55 by the printing pressure adjustment device 73, to a phase angle γ2 obtained after the adjustment.

More specifically, when the sheet thickness before the change satisfies k=k1, the phase angle γ1 of the motor 55 is temporarily obtained by looking up the conversion table 268*c*. At this time, when the printing pressure adjustment device 73 adjusts the printing pressure, the potentiometer 58 detects the phase angle γ'1 of the motor 55 after the printing pressure adjustment, and the printing pressure adjustment amount Δγ is obtained on the basis of the phase angles γ'1 and γ1. Subsequently, when the sheet thickness is changed from k1 to k2, the phase angle γ2 of the motor 55 is temporarily obtained. The printing pressure adjustment amount Δγ is added to the temporarily obtained phase angle γ2 of the motor 55, thus obtaining a phase angle (γ2+Δγ) of the motor 55.

In this manner, upon the change of the sheet thickness input to the sheet thickness input device 66 from k1 to k2, the phase angle of the motor 55 is changed from γ1 to γ2. At this time, the printing pressure adjustment amount which is adjusted before the change is added to the printing press between the coater double-diameter blanket cylinder 22 and lower blanket cylinder 29 which is obtained after the change, thus maintaining the printing pressure in the same state.

The adjustment and control operation of the third embodiment will be described with reference to FIGS. 18A to 18D. The controller 367 detects the phase angle β1 of the motor 45 on the basis of an output from a potentiometer 48 (step S91). The operator then determines whether or not the printing pressure between the upper blanket cylinder 25 and coater double-diameter blanket cylinder 22 has been adjusted by the printing pressure adjustment device 72 (step S92).

If no printing pressure adjustment has been performed, the process advances to step S96. If the printing pressure has been adjusted, i.e., if the printing pressure adjustment device 72 has been operated, the controller 367 drives the motor 45 to perform adjustment (step S93). Then, a phase angle β'1 of the upper blanket cylinder 25 is detected on the basis of the output from the potentiometer 48 (step S94). The amount Δβ=β'1−β1 of printing pressure adjustment for the upper blanket cylinder 25 which is to be performed by the printing pressure adjustment device 72 is calculated (step S95). The phase angle γ1 of the lower blanket cylinder 29 is detected on the basis of an output from a potentiometer 58 (step S96).

The controller 367 then determines whether or not the printing pressure between the lower blanket cylinder 29 and coater double-diameter blanket cylinder 22 has been adjusted by the printing pressure adjustment device 73 (step S97). If no printing pressure adjustment has been performed, the process advances to step S101. If the printing pressure has been adjusted, i.e., if the printing pressure adjustment device 73 has been operated, the motor 55 is driven to perform adjustment (step S98). Then, a phase angle γ'1 of the lower blanket cylinder 29 is detected on the basis of the output from the potentiometer 58 (step S99). The amount Δγ=γ'1−γ1 of printing pressure adjustment for the lower blanket cylinder 29 which is to be performed by the printing pressure adjustment device 73 is calculated (step S100).

Subsequently, the controller 367 reads the changed sheet thickness k2 input to the sheet thickness input device 66 (step S101). The controller 367 obtains the phase angle α2 of the motor 35 from the readout sheet thickness k2 by looking up the conversion table 268*a* (step S102). The controller 367 then detects the current phase angle α1 of the motor 35 on the basis of the output from the potentiometer 38 (step S103).

Then, the phase angles α1 and α2 are compared (step S104). If α1=α2, the phase angle α of the motor 35 is the phase angle α2 obtained from the sheet thickness k2. Thus, the motor 35 is not driven, and the process advances to step S109.

If NO in step S104, the motor 35 is driven (step S105). The current phase angle α of the motor 35 is detected on the basis of the output from the potentiometer 38 (step S106). If α=α2 (YES in step S107), the motor 35 is stopped (step S108). Thus, the coater double-diameter blanket cylinder 22 is adjusted to the position corresponding to the sheet thickness k2.

If NO in step S107, the motor 35 is kept driven, and steps S106 and S107 are repeated until x=α2 is obtained. Namely, the controller 367 controls the motor 35 such that the current motor phase angle detected from the potentiometer 38 becomes the phase angle obtained from the conversion table 268*a*.

The controller 367 obtains the phase angle β2 of the motor 45 from the sheet thickness k2 by looking up the conversion table 368*b* (step S109). The controller 367 then detects the current phase angle β1 of the motor 45 on the basis of the output from the potentiometer 48 (step S110).

The controller 367 compares the current phase angle β1 of the motor 45 with the phase angle (β2+Δβ) which is obtained by adding the adjustment amount Δβ, input from the gap amount input device 65 and obtained in step S95, to the phase angle β2 of the motor 45 obtained from the sheet thickness k=k2 (step S111). If β1=β2+Δβ, the phase angle β of the motor 45 is a value obtained by adding the adjustment amount Δβ to the phase angle β2 obtained from the phase angle α2 of the motor 35. Thus, the motor 45 is not driven, and the process advances to step S116.

If NO in step S111, the controller 367 drives the motor 45 (step S112). The current phase angle β of the driven motor 45 is detected on the basis of the output from the potentiometer 48 (step S113). If β=β2+Δβ (YES in step S114), the motor 45 is stopped (step S115). Thus, the upper blanket cylinder 25 is positionally adjusted to maintain its printing pressure with respect to the coater double-diameter blanket cylinder 22 which is obtained before position adjustment.

If NO in step S114, the motor 45 is kept driven, and steps S113 and S114 are repeated until β=β2+Δβ is obtained.

The controller 367 checks whether or not double-sided coating or reverse coating is selected by the coating mode selection button 71 (step S116). If the double-sided coating or reverse coating mode is selected, the controller 367 obtains the phase angle γ2 of the motor 55 from the sheet thickness k2 by looking up the conversion table 268*c* (step S117).

Subsequently, the controller 367 detects the current phase angle γ1 of the motor 55 on the basis of the output from the potentiometer 58 (step S118). Then, the controller 367 compares the current phase angle γ1 of the motor 55 with the phase angle (γ2+Δγ) of the motor 55 which is obtained by adding the adjustment amount Δγ, input from the gap amount input device 65 and obtained in step S100, to the phase angle γ2 of the motor 55 obtained from the sheet thickness k2 (step S119). If γ1=γ2+Δγ, the phase angle γ of the motor 55 is a value obtained by adding the adjustment amount Δγ to the phase angle γ2 calculated from the phase angle α2 of the motor 35. Thus, the motor 55 is not driven, and the control operation is ended.

If NO in step S119, the controller 367 drives the motor 55 (step S120). The controller 367 detects the current phase angle $\gamma$ of the driven motor 55 on the basis of the output from the potentiometer 58 (step S121). If $\gamma=\gamma 2+\Delta\gamma$ (YES in step S122), the motor 55 is stopped (step S123). Thus, the lower blanket cylinder 29 is positionally adjusted to maintain its printing pressure with respect to the coater double-diameter blanket cylinder 22 which is obtained before position adjustment.

If not the double-sided or reverse coating mode but the obverse coating mode is selected (NO in step S116), the lower blanket cylinder 29 is set at the throw-off position, i.e., at a position corresponding to the phase angle $\gamma 2=0$ of the motor 55 (step S124). Then, the controller 367 detects the current phase angle $\gamma 1$ of the motor 55 on the basis of the output from the potentiometer 58 (step S125). The current phase angle $\gamma 1$ of the motor 55 is compared with the phase angle $\gamma 2$ of the motor 55 which is set in step S124 (step S126). If $\gamma 1=\gamma 2$, the phase angle $\gamma$ of the motor 55 is the phase angle $\gamma 2$ set in step S124, i.e., corresponds to the throw-off position. Thus, the motor 55 is not driven, and the control operation is ended.

If NO in step S126, the motor 55 is driven (step S127). The controller 367 detects the current phase angle $\gamma$ of the driven motor 55 on the basis of the output from the potentiometer 58 (step S128). If $\gamma=\gamma 2$ (YES in step S129), the motor 55 is stopped (step S130).

If NO in step S129, the motor 55 is kept driven, and steps S128 and S129 are repeated until $\gamma=\gamma 2$ is obtained. Thus, the lower blanket cylinder 29 separates from the coater double-diameter blanket cylinder 22, thereby no varnish is transferred to the coater double-diameter blanket cylinder 22. Accordingly, obverse coating without coating of the reverse of the sheet is performed.

Figure 16A:
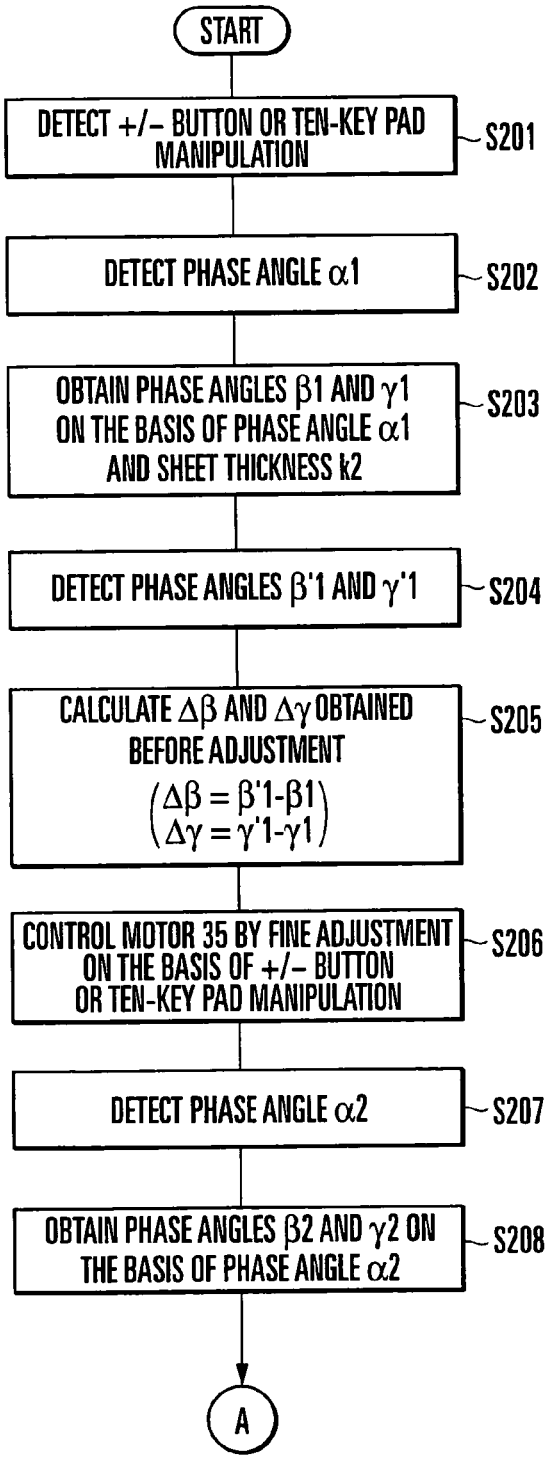
FIGS. 16A and 16B are flowcharts for explaining the operation of finely adjusting the gap amount t in the sheet processing apparatus shown in FIG. 13.
Figure 16B:
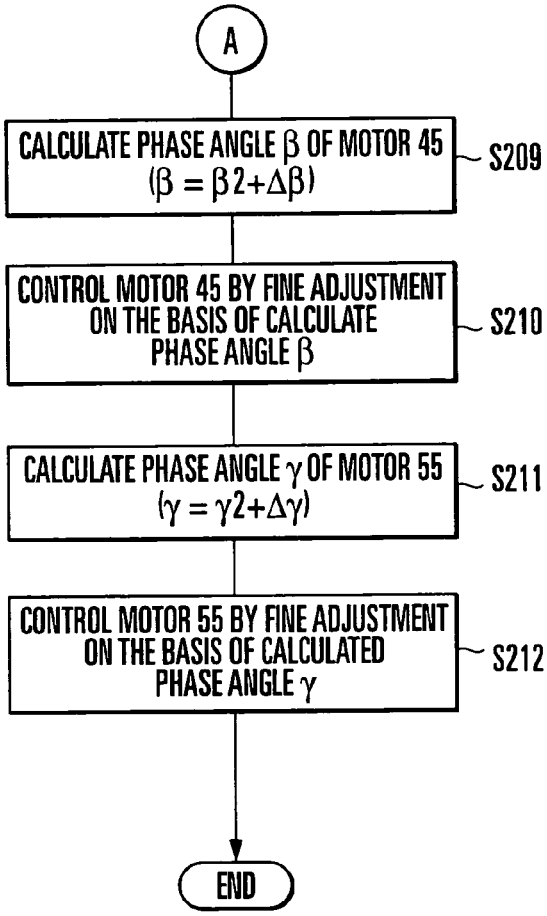

The fine adjustment operation of finely adjusting the position of the coater double-diameter blanket cylinder 22 of the apparatus of this embodiment, which is set and controlled on the basis of the sheet thickness k, will be described with reference to FIGS. 16A and 16B. This fine adjustment is performed by finely adjusting a gap amount t between the coater double-diameter blanket cylinder 22 and an impression cylinder 10*b*. In the fine adjustment operation, after the motor 35 is finely adjusted, the phase angle $\beta$ is obtained on the basis of the finely adjusted phase angle $\alpha$ and the sheet thickness k by adding the amount of printing pressure adjustment which is done before the fine adjustment, and the motor 45 is controlled. Also, the phase angle $\gamma$ is obtained on the basis of the finely adjusted phase angle $\alpha$ by adding the amount of printing pressure adjustment which is done before the fine adjustment, and the motor 55 is controlled.

The controller 367 detects the manipulation of a ten-key pad 65*a* or +/− button 65*b* (step S201). The controller 367 detects the phase angle $\alpha 1$ before fine adjustment by the potentiometer 38 (step S202). The controller 367 then obtains the phase angle $\beta 1$ of the motor 45 from the phase angle $\alpha 1$ before fine adjustment detected by the potentiometer 38 and a sheet thickness k3 input to the sheet thickness input device 66, by looking up the conversion table 68*b*. The controller 367 also obtains the phase angle $\gamma 1$ of the motor 55 by looking up the conversion table 68*c* (step S203). Subsequently, the controller 367 detects the phase angles angle $\beta'1$ and $\gamma'1$ before fine adjustment based on the outputs from the potentiometers 48 and 58 (step S204). The controller 367 then calculates the amount of printing pressure adjustment done before fine adjustment, i.e., the phase adjustment amount $\Delta\beta$ ($=\beta'1-\beta 1$) of the motor 45, on the basis of the phase angle $\beta 1$ which is obtained on the basis of the phase angle $\alpha 1$ and the phase angle $\beta'1$ which is detected by the potentiometer 48. The controller 367 also calculates the amount of printing pressure adjustment done before fine adjustment, i.e., the phase adjustment amount $\Delta\gamma$ ($=\gamma'1-\gamma 1$) of the motor 55, on the basis of the phase angle $\gamma 1$ which is obtained on the basis of the phase angle $\alpha 1$ and the phase angle $\gamma'1$ which is detected by the potentiometer 58 (step S205).

Subsequently, the controller 367 obtains the phase angle $\alpha 2$ of the motor 35 from the fourth conversion table 68*a* on the basis of the fine adjustment of the gap amount t done by the detected manipulation of the ten-key pad or +/− button, and controls the motor 35 by fine adjustment on the basis of the phase angle $\alpha 2$ (step S206). The controller 367 displays the finely adjusted gap amount t on a display 65*c*.

Subsequently, the controller 367 detects the phase angle $\alpha 2$ after fine adjustment by the potentiometer 38 (step S207). The controller 367 then obtains the phase angles $\beta 2$ and $\gamma 2$ of the motors 45 and 55 on the basis of the phase angle $\alpha 2$ after fine adjustment which is detected by the potentiometer 38 and the sheet thickness k2 which is input to the sheet thickness input device 66, by looking up the conversion tables 68*b* and 68*c* (step S208).

Subsequently, the controller 367 calculates the phase angle $\beta(=\beta 2+\Delta\beta)$ of the motor 45, obtained by adding the phase adjustment angle $\Delta\beta$ corresponding to the amount of printing pressure adjustment done before fine adjustment to the phase angle $\beta 2$ obtained on the basis of the phase angle $\alpha 2$ (step S209), and controls the motor 45 by fine adjustment on the basis of the phase angle $\beta$ (step S210).

Subsequently, the controller 367 calculates the phase angle $\gamma$ ($=\gamma 2+\Delta\gamma$) of the motor 55, obtained by adding the phase adjustment angle $\Delta\gamma$ corresponding to the amount of printing pressure adjustment done by fine adjustment to the phase angle $\gamma 2$ obtained on the basis of the phase angle $\alpha 2$ (step S211), and controls the motor 45 by fine adjustment on the basis of the phase angle $\gamma$ (step S212).

In the above description, fine adjustment control performed when the coating mode selection button 71 selects double-sided coating is explained. When obverse coating is selected, the lower blanket cylinder 29 is kept to be spaced apart from the coater double-diameter blanket cylinder 22. Namely, the controller 367 performs control of fixing the phase angle of the motor 55 at $\gamma=0$.

In the above-described embodiments, the sheet thickness input device 66 is exemplified by a ten-key input device to which the operator inputs the sheet thickness k manually. Alternatively, a sheet thickness measurement device which measures the thickness of the sheet before printing automatically may be used.

Figure 17:
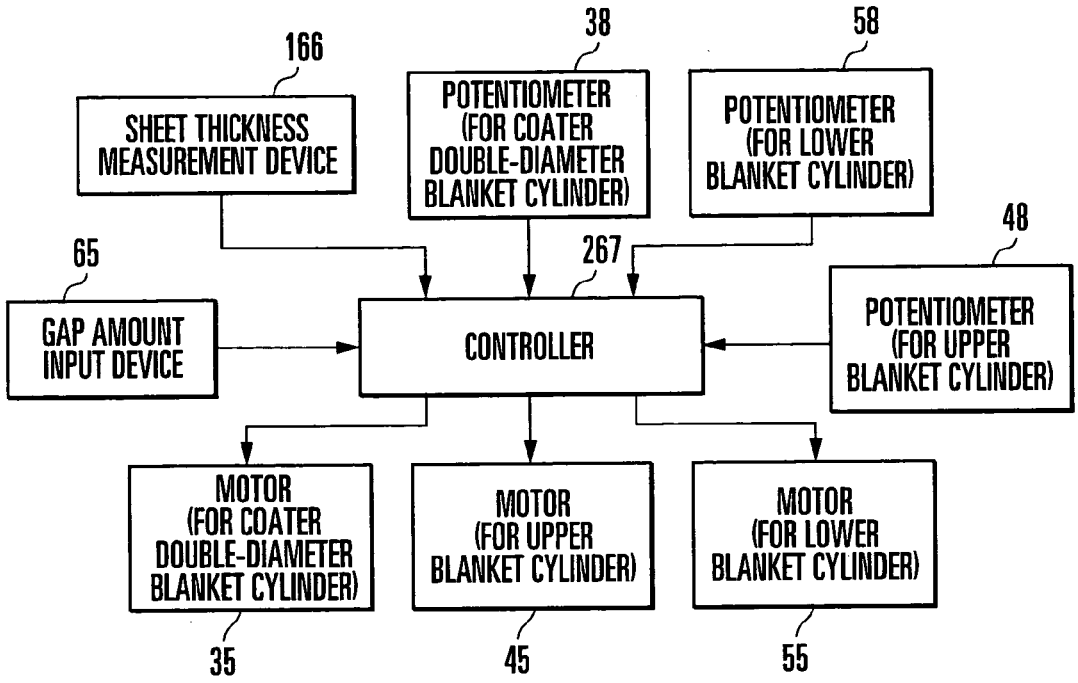
FIG. 17 is a block diagram showing the electrical arrangement of a sheet processing apparatus according to the fourth embodiment of the present invention.

FIG. 17 shows the fourth embodiment of the present invention which uses a sheet thickness measurement device. This embodiment comprises a sheet thickness measurement device 166 in place of the sheet thickness input device 66 in FIG. 7A. A controller 267 controls motors 35, 45, and 55 on the basis of the measurement result of the sheet thickness measurement device 166.

In the above-described embodiments, the sheet thickness input device 66 is exemplified by a ten-key input device to which the operator inputs the sheet thickness k manually. Alternatively, a sheet thickness reading device which reads a barcode formed on a sheet before printing or code information stored in an IC tag prepared for each sheet lot may be used.

Figure 18:
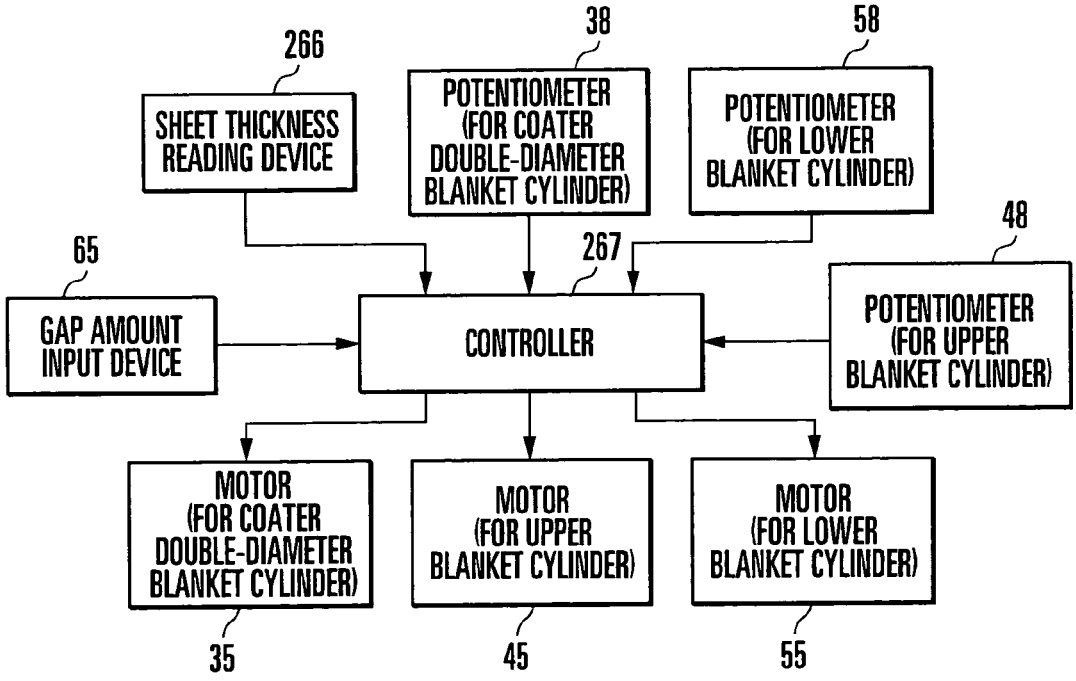
FIG. 18 is a block diagram showing the electrical arrangement of a sheet processing apparatus according to the fifth embodiment of the present invention.

FIG. 18 shows the fifth embodiment of the present invention which uses a sheet thickness reading device. This embodiment comprises a sheet thickness reading device 266 in place of the sheet thickness input device 66 in FIG. 7A. A controller 267 controls motors 35, 45, and 55 on the basis of the readout result of the sheet thickness reading device 266.

As has been described above, according to the present invention, when transferring a sheet from the transport cylinder to the first cylinder, if the sheet is scratched depending on the thickness or material of the sheet, the controller drives the first driving means to adjust the gap amount between the first cylinder and transport cylinder. Not only adjustment can be performed within a short period of time, but also the load to the operator can be reduced and the productivity can be improved.

As the gap amount between the first cylinder and the upstream transport cylinder is adjusted, the second and third driving means are driven to adjust the printing pressures of the second and third cylinders. This enables adjustment to maintain the printing quality to complete within a short period of time. This can also decrease waste paper.

What is claimed is:

1. A sheet process apparatus comprising:

a first cylinder which receives a sheet from an upstream transport cylinder and holds the sheet;

a second cylinder which is disposed to oppose said first cylinder and prints/coats the sheet held by said first cylinder;

a third cylinder which is disposed to oppose said first cylinder and supplies ink/varnish to a circumferential surface of said first cylinder;

first driving means for adjusting a gap amount between said first cylinder and said upstream transport cylinder, second driving means for adjusting a position of said second cylinder with respect to said first cylinder;

third driving means for adjusting a position of said third cylinder with respect to said first cylinder;

thickness input means for inputting a thickness of the sheet; and control means for controlling said first driving means, said second driving means, and said third driving means in accordance with the sheet thickness from said thickness input means, gap amount input means for inputting the gap amount between said first cylinder and said upstream transport cylinder, wherein said control means further controls said first driving means in accordance with the gap amount from said gap amount input means;

wherein said control means controls said first driving means in accordance with the gap amount based on the sheet thickness from said sheet thickness input means, to set a position of said first cylinder at a reference position, and controls said first driving means in accordance with the gap amount adjusted by said gap amount input means, thereby finely adjusting the position of said first cylinder.

2. An apparatus according to claim 1, wherein said gap amount input means comprises a +/− button which changes a current gap amount by a predetermined amount in one of a + direction and a − direction with one manipulation.

* * * * *